US006970103B2

(12) United States Patent
Bortolotto

(10) Patent No.: US 6,970,103 B2
(45) Date of Patent: Nov. 29, 2005

(54) SYSTEM AND A METHOD FOR EVENT DETECTION AND STORAGE

(76) Inventor: Persio Walter Bortolotto, Rua Vereador Nelson Abraão, 1176, 87015-230 Maringá, PR (BR)

( * ) Notice: Subject to any disclaimer, the term of this patent is extended or adjusted under 35 U.S.C. 154(b) by 72 days.

(21) Appl. No.: 10/474,132

(22) PCT Filed: Apr. 4, 2002

(86) PCT No.: PCT/BR02/00048

§ 371 (c)(1),
(2), (4) Date: Oct. 6, 2003

(87) PCT Pub. No.: WO02/082400

PCT Pub. Date: Oct. 17, 2002

(65) Prior Publication Data

US 2005/0151671 A1 Jul. 14, 2005

(30) Foreign Application Priority Data

Apr. 4, 2001 (BR) ..... 0102542

(51) Int. Cl.[7] ..... G08G 1/054
(52) U.S. Cl. ..... 340/937; 340/936; 340/938; 340/941; 340/933; 342/104; 342/66; 701/93; 701/119
(58) Field of Search ..... 340/937, 936, 340/938, 941, 933; 342/104, 66; 701/93, 701/119

(56) References Cited

U.S. PATENT DOCUMENTS 4,219,878 A * 8/1980 Goodson et al. ..... 702/143
5,432,547 A * 7/1995 Toyama ..... 348/149
5,935,190 A * 8/1999 Davis et al. ..... 701/119
5,938,717 A 8/1999 Dunne et al.
5,948,038 A 9/1999 Daly et al.
6,111,523 A * 8/2000 Mee ..... 340/937
6,121,898 A 9/2000 Moetteli
6,681,195 B1 * 1/2004 Poland et al. ..... 702/142

FOREIGN PATENT DOCUMENTS

| | | |
|---|---|---|
| DE | 198 02 811 A1 | 7/1999 |
| DE | 198 10 302 A1 | 9/1999 |
| EP | 0 593 979 A1 | 4/1994 |
| EP | 0 621 572 A1 | 10/1994 |
| EP | 0 741 377 A1 | 11/1996 |
| FR | 2 678 412 A1 | 12/1992 |

* cited by examiner

*Primary Examiner*—Jeffery Hofsass
*Assistant Examiner*—Daniel Previl
(74) *Attorney, Agent, or Firm*—Arnold & Porter LLP

(57) ABSTRACT

An event detection and storage system comprising: a vehicle detection device connected to an input vehicle, a traffic sign red light detector, a registered vehicles monitoring array, a control module that manipulates an infraction film in association with the registered vehicles monitoring array, a video capture device that supplies images to the control module, and reception device connected to the radar, an excess speed alert device, and a semaphore control connected to an output port, the system being configured in such manner that during the operation thereof there is generated the film such that when an event occurs, there is obtained a film of the moments that preceded the event, during the event and after the event. The invention also discloses an event detection method using the above system.

8 Claims, 20 Drawing Sheets

SYSTEM AND A METHOD FOR EVENT DETECTION AND STORAGE

CROSS-REFERENCE TO RELATED APPLICATIONS

This application is a 371 filing of International Application No. PCT/BR02/00048 filed Apr. 4, 2002 which claims the benefit under 35 U.S.C. § 119 of Brazilian Patent Application No. PI 0102542-2 filed Apr. 4, 2001.

FIELD OF THE INVENTION

The present invention is related to a system, an equipment and a method intended to detect, store and control events, particularly in connection with fleets, vehicles and traffic violations, and intended for informing and educating drivers, primarily with regard to traffic taking place in roadways.

BACKGROUND OF THE INVENTION

The lack of traffic discipline in Brazil, and the consequent impunity of the drivers, has lasted for many years, until the enactment, in Sep. 23, 1997, of Law No. 9,503, known as the National Transit Code, hereinafter referred to as the CTB. Prior to the existence of the CTB the figures relative to deaths caused by traffic accidents and automobile crashes were alarming, and Brazil was one of the leading countries in terms of percentage of traffic-related casualties.

Statistics provided by the Federal Road Police evidence that subsequently to the enactment of the CTB the number of casualties resulting from traffic accidents was not significantly reduced, corresponding to a mere 0.7% decrease, serving to demonstrate that the supervising methods produce little effect in educating our Country's drivers.

Brazil has a "casualty index" well above that of developed countries. That index measures the number of deaths for each group of 10,000 vehicles and is used worldwide to provide an indication of violence in traffic. In 1997, the casualty index in Brazil was 8.00. Countries like Japan, Italy, the USA, France, Germany and Austria have indexes ranging from 1.50 to 4.00.

Unfortunately, both facts and statistics evidence that the traffic behavior of the Brazilians has not changed much since the enactment of the CTB. The administrative and judicial jurisprudence points to the fact that there is no great result to be achieved by punishment without education. Therefore, at this time, the major objective and also the major challenge of the CTB is to educate the Brazilian population.

With the CTB, in addition to severe penalties for infractions, there was a change in the policies relative to control and supervision of traffic in our Country, putting an end to a long period of existence of an inefficient supervision system. Each traffic violation started to be counted in terms of points, whereby upon accumulating 20 points the driver loses his driving license.

The CTB brought about a positive aspect, where it established limits to the rights and the duties of the Public Authority, aiming at making supervision more effective. In the past, it was not precisely established which entity was actually in charge of controlling and supervising the traffic in the streets and roads of Brazil, and in many instances there occurred confusing actions involving the Municipalities, the States and the Federal Union, leading to inapplicability of the transit laws.

As a consequence of such lack of delimitation, members of the families of traffic accident victims usually brought legal suits against the Municipal authorities, attributing thereto the figure of the passive pole (defendant) in the suit, but also indicating the State and the Union as co-responsible parties due to the omission of signaling and/or supervision in place.

The slowness of the Brazilian judicial system worsened this situation of absence of definition of liability of the public entities involved. In some cases, after 20 years, the victim's family members still await a decision determining at which level, Municipal, State or Federal, actually lays the liability for payment of an indemnity.

The CTB determined that, as a general rule, the State is responsible for supervising the compliance of vehicles with the regulations applicable thereto (IPVA), and the Municipality is in charge of supervising the circulation of the fleet, covering the events of speed violations, failure to obey red lights, irregular parking, and collecting the revenue derived from the fines applied in connection with the previously cited infractions, and using such revenue to expand and improve the signage system and the supervision of urban thoroughfares.

Due to the reduced staff of police officers and supervisors, the municipal traffic engineering companies, together with the Transit Departments—DETRANS, started to use the so-called electronic monitoring or supervision, using traffic monitoring and control equipment to detect infractions.

The main purpose of such equipment consists in the detection of traffic violations related to excessive speed and disregard of red lights, aiming to decrease the number of accidents and to discipline the vehicle drivers. For this motive, the locations for installation of electronic supervision equipment are selected based on a high rate of accidents. Either by mere coincidence or otherwise, such equipment was installed in the main thoroughfares of the city, consequently those having the highest vehicle circulation rates, but one can not affirm which of the factors actually served to determine the choice of the locations.

Electronic monitoring is recent in Brazil, and has been in use for less than 10 years. However, in Europe and in the United States this resource has been in use for almost 30 years. Much to our surprise, in this short time span, Brazil already stands in the first ranks in terms of use of electronic monitoring machines.

It is known that an increase in the numbers of public officials is not the most simple of tasks, and it is frequently hindered by legal, bureaucratic and financial difficulties. The Mayor's office budget allowance limits the expenses with payroll to 60% (sixty percent). Since almost all the municipalities have already reached this percentage, and in some cases have actually exceeded the same, they therefore became unable to hire new supervising agents. The supervision using electronic equipment came to fill in this gap, having become an alternative to the municipalities, both under an administrative point of view, and in financial terms.

According to the CET RIO, for example, the electronic supervision points are preceded by sign plates, intended to alert the users to comply with the legislation and legal rules. This fact does not occur in practice (or if it occurs, it is not very effective), and for this reason, along these almost four years of enforcement of the Code, those machines came to be nicknamed "slot machines" by drivers finding themselves victims of unfair treatment.

In a paper published in Traffic Safety, Graham provides an overview of the controversy between those members of the community that are favorable to the detectors and those that oppose the same. In this study, Graham provides scientific evidence regarding the difficulty to educate drivers by using electronic detectors. (Graham, S. Police battle speeders. Traffic Safety, November/December 1996, pp. 8–12).

Among the points that make it difficult to educate the driver is the time lapse between the issuance of the fine and the act of infringement itself, causing little or no effect in terms of changing the traffic behavior.

The electronic supervision devices may generate a great number of citations, with a small expense incurred with personnel in loco. The use of these devices causes a concern regarding traffic safety, such concern (Hoff, 1997) being centered upon the lack of capacity of the officer to decide on whether to issue a citation, the delay between the event and the citation preventing the defendant to have an adequate opportunity to submit a possibly successful defense. In many cases, these citations generate consequences of small import, for example fines of small value, rendering it impractical to accept the expenses involved in mounting a defense. (Hoff, C. Legal issues surrounding photo-radar speed enforcement. WesternITE, July–August 1997, 51(4), pp. 1–3,9).

The primary purpose when punishing a traffic violation consists in educating the driver that committed the violation, however the distance between the event and the receipt of the fine causes this objective to remain unfulfilled in the majority of instances, since the driver no longer remembers the infraction that he or she did commit.

The great number of fines issued increases the time distance between the event and the receipt of the fine. With the present state of the art, there shall occur an even greater increase of this time lapse, that in many cases will entail the actual disregard thereof, since the traffic violation citations must be delivered to the drivers within a term of 30 (thirty) days.

In countries like Brazil, where people persistently try to dodge the law using the famous Brazilian "jeitinho" (ruse), the greater the lapse of time between the infraction and the receipt of the fine, the greater will be the possibility of appearance of "gangs" specializing in withdrawing from the system fines that have not as yet been issued, where in general such schemes originate at the very agency that is in charge of issuing the fine.

Studies conducted concerning electronic supervision were revised and synthesized by Blackburn and Gilbert (1995), where an analysis was made in respect of the electronic supervision programs of the United States, Australia, Canada and Europe. The major conclusion derived from these studies is based on the inefficiency of these types of equipment, having in view that they might reduce speeding, accidents or even some injustices. On the other hand, the extension of the benefits does not occur in the same proportion, and is essentially dependent upon the details of the situations that generated the infractions. These studies basically reexamined the history of use of electronic supervision, primarily in the United States, where there were analyzed and taken into consideration the legal and technical requisites for the use of this equipment, and a review was conducted in respect of the problems encountered in the use thereof. (Blackburn, R. R., and Gilbert, G. T. Photographic enforcement of traffic laws. NCHRP Synthesis of Highway Practice no. 219, 1995. Transportation Research Board, 2101 Constitution Avenue, NW, Washington, D.C., 200418, USA).

The state of the art shows that it does not suffice to have latest-generation equipment, as is the case in the United States, but it is also necessary to make it function in an effective and fair manner. Technology is intended to serve mankind, and we should not become subservient to this equipment without an interference of human analysis in this chain: vehicle, infraction, fine.

Although the use of this type of equipment in Brazil is more recent than in the countries cited above, Brazil does not derive a privilege therefrom, as the problems disclosed in these studies regarding electronic supervision have been occurring in our Country in a systematic fashion. Therefore, there should be questioned the equipment used to date and the forms of supervision provided thereby.

There exist at present two types of electronic supervision equipment. The first is the fixed camera to register disregard of red stoplights. This equipment is installed on traffic lights and is coupled to sensors installed only under the retention strip. When the light turns red the equipment is activated and records the vehicles that cross the red light, by means of two photographs. The first is taken in the instant when the vehicle crosses the sensor and after an interval between 0.5 and 10 seconds, the second photograph determines whether the vehicle actually ignored the red light or remained stationary over the strip.

The second is the portable or fixed radar for speed measurement. This equipment measures the speed of the vehicles by means of a precise focusing of a radar beam that operates using various forms of detection, one of which is based on the Doppler principle (waves emitted at speeds near the speed of light), monitoring up to three lanes. In the instant when a vehicle crosses the radar beam at a speed above the permitted speed, a photograph is taken including the date, hour, location code, allowed speed and the speed of the infractor.

The forms of speed measurement used in the electronic monitoring and supervision equipment are:

1) Microwave radar—there are two types of microwave detectors, the first transmits electromagnetic energy in a constant frequency, in order to measure the vehicle speed, using the Doppler principle, and the second type of microwave radar transmits a memorized waveform, also called a modulated frequency wave, which varies the transmitted frequency continuously with time, allowing to detect stationary vehicles.
2) Passive infrared detector—supplies the data relating to the passage and the presence of the vehicle, but not the speed.
3) Active infrared detector—operates in a fashion similar to the microwave detector. A laser is used to transmit energy close to the infrared spectrum (approximately 0.9 micrometers in length) whereof a portion is reflected back to the receptor of the detector by a vehicle that is within the field of vision of the instrument. It supplies data on the passage, presence and speed of the vehicle.
4) Ultrasonic detectors—the ultrasonic detectors were created to receive the data relative to Doppler effect and range.
5) Passive acoustic detectors—these devices produce acoustic energy or an audible sound. When a vehicle crosses the detection zone, the signal processing algorithm detects an increase of the sound allowing a reduction of the speed.
6) Magnetic detector.
7) Video image processor—the processor identifies vehicles and parameters associated with traffic flow by means of an analysis of images supplied by video cameras. Using specific computing structures, the images are digitized and transmitted by means of a series of algorithms that identify changes in the background image.

Following the installation of the electronic supervision equipment, there occurred a great increase in the number of fines issued. We cite, for example, the case of the Transit Department (DETRAN) of the State of Rio de Janeiro, which during the year 2000 issued a total 1,868,064 fines, whereof 870,573 were issued in the city of Rio de Janeiro. The most frequent infractions are: speed up to 20% in excess of the maximum allowed speed —831,824 fines; violation of red light or mandatory stop—204,444 fines; and speed 20% above the maximum allowed speed—193,697 fines.

The indiscriminate use without comparative antecedents has been generating anachronic or anomalous results. For example, vast percentages, or even the entire fleet of a city is fined during the course of one year, without there occurring the counterpart of a decrease in accidents and fatalities, a sine qua non condition to justify the use of such equipment.

An atypical fact occurred in the municipality of Belém (State of Pará). Following the installation of the municipality's electronic traffic supervision and control system, the entire fleet of the municipality was fined, resulting in a popular commotion against the electronic supervision.

The current state of the art does not generate irrefutable evidence of the detected infractions, and in the majority of the cases it generates unfair, or even irrelevant evidence. This comes as a consequence of the waiving of supervision performed by human beings, in favor of the option for supervision performed by an electronic equipment that merely records the act of infringement in a photograph. Such equipment does not provide a record of the events that preceded the act of infringement or that occurred thereafter, where if such events could be properly analyzed, they might constitute irrefutable evidence to justify the fact as not constituting an actual infraction.

When a fixed radar is used for measurement and supervision of excessive speed, there is noted that in the majority of times the driver driving the vehicle at a speed above that which is allowed as a limit, proceeds to brake or to reduce his speed a few meters before passing by the radar, and a few instants after having passed by the radar, resumes his driving at the prior excessive speed.

Furthermore, upon analyzing the data, it is noted that this presently used equipment, in most cases, only imposes penalties on drivers that exceed the speed limit due to being but slightly above the established speed limit when passing by the radar. If the average speed of the driver could be measured, that same infraction might possibly be disregarded.

Thus, the state of the art provided by the cited existing equipment is not able to prevent excesses from the part of the municipal administration officials, or unfair situations, such as those described above.

With all these shortcomings implemented by the state of the art, already duly identified, other equipment was devised in an attempt to find solutions for the problems, but such equipment also evidences shortcomings of its own.

A system for supervision of compliance with traffic regulations, that is the object of U.S. Pat. No. 6,121,898, consists in two or more working units and at least one host computer connected through network devices. The working units are fixed separately at a certain distance and each unit includes a plate reading device. The host computer receives inputs from two units that are not necessarily working units adjacent to one another, including identification of indicia, e.g. identification of the license plates of the vehicles that have passed. The working unit and the host computer cooperate to compute the average speed of a vehicle passing between the two units, by means of the use of inputs of: (a) minimum travel time to cover distances between working units, which latter transmit compared indicia, (b) sending of speed limit data between two working units, whereto is transmitted information comparing vehicle license plates, and (c) time lapse between the transmission of the comparison of identification of indicia to the host computer. Optionally, after a predetermined time lapse has expired, the information relative to a vehicle not corresponding to a violation is deleted.

The equipment described above needs to include at least two working units in order to be able to identify the indicia, registers only the moment of the infraction, operates solely with video cameras, no alternative forms for generating images being disclosed. After a predetermined period of time, the images that fail to correspond to a violation are deleted. However, the system does not disclose which is the party or entity that is responsible for this analysis. It does not make it possible to record events having occurred prior to the infraction or after the same.

A system for monitoring objects or for monitoring vehicles, that constitutes the object of U.S. Pat. No. 5,809,161, includes a connection camera for monitoring the movement of an object, determining a time for acquisition of an image, in order that the image of an object be acquired in a predetermined time. The system includes a camera that is able to monitor objects and images of processed circuits, sensitive to the camera, which is also able to detect the movement of a predetermined object, from among other static and moving objects. The information identifying the object may be automatically extracted from the acquired image. The system is particularly adjusted for large-scale monitoring and discrimination of vehicles, from among other vehicles on a highway with multiple lanes and acquires high-resolution images of large vehicles at a predetermined acquisition point. The data and information relative to the acquired images, by means of a plurality of connected cameras, may be sent over a digital communications network to the central processing system, which may extract the identification data of the vehicle, as well as details of the vehicles' license plates and obtain information between the connections, regarding a vehicle in movement.

The system given as an example above is primarily intended for the control and monitoring of the fleet of vehicles, it is not intended to record images of traffic violations, and functions solely by using cameras.

The traffic monitoring system that constitutes the object of U.S. Pat. No. 5,935,190 has a common enclosure for a Doppler transceiver radar, a video camera and a digital computer for processing the Doppler signal. The system also includes a VCR, a high-speed photographic camera, and a laptop computer for downloading control settings, originating from a program stored in a floppy disk or a memory card, to be sent to the digital computer. The digital computer performs an initial self-test by means of input of a calibration signal in one place. The modem of the radar generates a two-channel Doppler signal, and the phase between the two channels indicates whether a vehicle is approaching or distancing itself from the radar modem. The two channels are recorded in the left and right audio channels of a VCR. The speeds of the vehicles detected in the system are recorded together with this video signal and are stored in the memory, with the purpose of providing a recording evidencing the traffic conditions when bringing a suit against an infringing driver. The image in the recording may also include a successive series of speed measurements in respect of each vehicle. Although an operator might be able to hear the Doppler signal, it is preferred to have a digital computer activate a sound alert to emit a sound shot when the system detects a vehicle, and emitting a sound when the vehicle exceeds the permitted speed limit.

This system is intended to measure the exact speed of the vehicle when passing by the radar, and does not allow to measure the average speed thereof. Furthermore, this system does not allow to record the event itself only of the moment when the infraction actually occurs. It operates exclusively by means of the Doppler type radar and requires an operator. No records are made of previous and subsequent events.

The vehicle speed monitoring system that constitutes the object of U.S. Pat. No. 5,734,337 consists in a method to determine the speed of the vehicle by using a camera. The method automatically compensates for a certain speed as evident for imperfections due to the position of the camera and the respective vehicle. The invention disclosed in that US patent also includes a method for calibration of a camera to compensate imperfections due to the position of the camera.

SUMMARY OF THE INVENTION

The object of this invention constitutes an alternative to already existing equipment, since it is preferentially directed at measuring the average speed of the vehicle between two points, being thereby more effective and fair in terms of supervision of speed infractions. In this manner, an individual that unwittingly exceeds the limit when passing by the radar shall be benefited, on the other hand, an individual that is found to be permanently above the authorized speed limit shall be punished.

Since in the current state of the art relative to control of events and traffic (crossing a red light, for example) with or without additional functions, there are taken up to two photographs of the event, several parameters are not capable of being assimilated thereby, as well as the circumstances that preceded or took place subsequently to the recorded event, and thus unfair and even illegal situations frequently occur, aggrieving both drivers and individuals that need to establish a fair assessment of the registered events.

With the inventive step as evidenced, the task of analysis of the event returns to the human field such as to allow, for example, the application of fines only in connection with events that constitute actual traffic violations and thus diminishing the injustice arising from the electronic fining industries set up in various Brazilian cities.

As is well known, the systematic replacement of police officers at street crossings by machines that record red light crossing violations has generated many problems for the drivers and users of the thoroughfare systems. The machines operate with perfect precision in generating fines. However, these machines obviate the possibility of rationalizing the analysis of the events, precisely in a field where good sense must prevail, as may be noted in the examples below:

Example 1: a vehicle in motion tries to stop at a yellow light, but only manages to stop over the retaining strip, while another vehicle stops close behind the first, preventing it to move backwards. The red light violation recording machine will certainly record the event as an infraction. If a police officer was present at that crossing, would he apply a fine?

Example 2: a vehicle stopped at a crossing with the red stop light on blocks the passage of a Fire Truck or an Ambulance sounding its siren. If the vehicle moves forward in order to give passage to any of these other vehicles its proprietor will certainly receive a fine, and the Fire Truck or Ambulance will not necessarily be photographed, since it may happen that at the moment when such other vehicle crosses the retaining strip and the pedestrian strip the light has already turned green, rendering it impossible for the first vehicle to explain the reason why it jumped the light. If a police officer was present at that crossing, would this officer apply a fine? Or would the police officer act otherwise, instructing the first vehicle to allow the second vehicle to pass?

Example 3: A suspect individual walks towards a vehicle stopped at a red light. In order to avoid a possible robbery, the driver jumps the red light, and certainly the proprietor of the vehicle will be issued a fine. If a police officer saw that scene, would he fine the vehicle? Would not the fact in itself of the robbers knowing that they were being filmed drive them away from these locations?

The object of the invention presently disclosed presents as a major differentiating factor the interest in capturing the images of the events occurring before and after the central event, increasing the fairness in application of fines, since it shows the circumstances that caused the infraction to take place.

The object of the present invention is capable of registering and parameterizing several frames (photographs) per second (preferably 5 or more) during several seconds, thus making it possible to view the facts that preceded the event and the circumstances subsequent to the fact that determined the registered event. This system and method is clearly above and beyond the current state of the art, since it allows to analyze the event including all of its circumstances and causes, for example, (if used in traffic control), whether the vehicle failed to move backwards due to the presence of another vehicle behind it, or whether the vehicle crossed the red light to give passage to a fire engine or an ambulance or yet in an attempt to avoid a hold-up, since all of this will have been recorded.

The system and method in question are able to make use of cameras or any other form of obtaining images, with panoramic and/or having zoom (telephoto lens) characteristics, of the place where it is intended to monitor events, such as the lanes that are parameterized using a method, recording the images continuously in a memory loop, of a size to be defined according to the requirements for capture of the pre-event. i.e., if it is defined that there should be stored three seconds of recording prior to the occurrence of the infraction, there is determined that the loop memory should always store the most recent ninety frames and for each new frame that is stored in the loop memory an older frame shall be discarded, and when certain parameters are reached (e.g. when an infraction actually takes place), the contents of the loop memory are definitively stored in a mass memory medium.

Upon determining the area to be monitored, for example, upon focusing a crossing, the parameters are delimited and thus, when an object (e.g. a vehicle) reaches any one of the established parameters, a pickup device recognizes this change and stores definitively the content of the pre-event from the loop memory and thereupon starts to capture in real time the post-event, in the form of parameters also established in the system. This procedure waives the expensive requirement of installation of physical detectors in the lanes, leaving scars in the asphalt, and also rendering unnecessary the use of laser or ultrasonic motion sensing mechanisms, lowering the cost of event and traffic control.

The system and method as described records and stores events and transmits and relays the same simultaneously (for example, via radio) to relayers, concentrators and/or exchanges, for the purpose of enabling the analysis of the occurred event by various individuals/agencies or systems in charge thereof, or by other systems, there being possible to have an unlimited repetition of the recorded event, allowing the performance of actions and entries in registries. The system and method works with multiple parameters and performs multiple tasks. Therefore, together with the capture, this system and method may operate panels with time information, transmitting the identification of vehicles passing by the location where the equipment is installed (e.g. via wireless radio) to a central office where these vehicles are subject to control, or to security centers having records of stolen vehicles.

The system and method for monitoring events (such as traffic) described in this invention, simultaneously with the image capture service, may actuate traffic light panels with auxiliary time information, such as panels with green and red led strips that diminish in size according to the time reduction of the traffic light stage in question. This red light time information is made available by intelligent traffic lights. The time information made available at the traffic light panel is captured by the system and method together with the images of the object in motion (e.g. the vehicle) with independent parameters (for example, crossing the retaining strip, crossing the pedestrian strip, finally advancing through the crossing, and if this vehicle comes to cause an accident by running over someone or by collision, this will be stored in the mass memory of the electronic equipment and may be analyzed an infinite number of times).

Such data is very valuable, for example, to solve conflicting situations where both drivers of vehicles involved in a collision affirm that they were passing by a green light. Whenever the red light is activated, a chronometer is activated in the screen that might come to be captured; this chronometer will have two digits for seconds and two digits for tenths of seconds, thus allowing that by means of a simple analysis of the event one may know how many seconds upon activation of the red light the infringing vehicle passed by the crossing. This chronometer might constitute the redemption of many vehicles that are caught at the first thousandth of a second after the activation of the red light, and are thereby fined, when one knows that it is impossible to achieve such precision in stopping a vehicle in motion. There should be additionally considered that if the common pickup device is connected to the red lamp of a common traffic light and not to a traffic light having auxiliary time information, it becomes much more difficult for the driver to guess that the green light period is about to expire and to be able to stop his or her vehicle during the short yellow-light period with a millisecond accuracy. The data, information and parameters concerning each event (e.g. place, time, chronometer and other data required to correctly record the event) are recorded in a manner that is harder to alter subsequently than in the current state of the art (e.g. in the image itself and not in two files), the data recorded in the image thus becoming as part thereof, greatly increasing the level of security and trustworthiness of the data, impeding adulterations of the data relative to the event. Simultaneously, events and parameters shall be relayed (for example, via wireless radio), as already described above, to a place where they may be analyzed by individuals certified for such purpose. The transfer of data (for example, by wireless means) allows great economy, swiftness and security to the public authorities, since it does not require installation of cabling over common posts or the permanent lease of a twisted conductor pair from the telephone service utility, and also does not require the most common form of operation using vehicles, ladders and personnel performing more than one daily round for each equipment, to collect stored data, as in the case of the conventional pickup devices. The images and data will be transported with a high level of security since there shall be in use a private data transfer path with cryptographic security.

The system and method having been described also make it possible, either simultaneously or not, to measure speed using the concept of average speed along a course. At present, the radars known as "pardais" (sparrows) measure the speed of the vehicle in an instantaneous fashion, that is, when the vehicle passes by a physical detector implanted in the paving, the speed thereof at that moment is measured and if the vehicle is traveling at a speed in excess of that road's speed limit, it is photographed. However, it is easy for current vehicles to quickly increase their speed due to the fact of being powerful or due to the vehicle being on a downhill course, and sometimes—momentarily—they exceed the road's speed limit and are fined.

Using the concept of average speed there are defined measurement parameters, dependent on the length of the section that is intended to be monitored. The vehicle shall be fined only if its speed stays beyond the allowed speed limit for the roadway along the entire section, or the major part thereof, thus substantially reducing the quantity of fines applied for excessive speed, since the great majority of fines caused by detections made by instantaneous radars occur due to minor oversights, in most instances in the absence of an intention to exceed the roadway speed limit.

One of the possible forms of functioning of this modality of capture is as follows: The monitoring routine is initiated by the presence of a physical object, a vehicle, at any point, equipped with means for automatic alphanumeric recognition of data from the vehicle's license plate, and which although being at a distance of at least fifty meters, but connected to, another pickup device (for example, by means of wireless radio waves), (wherein also the data of the vehicle's license plate are captured by the means of automatic alpha-numeric recognition of data), the latter receives from the first pickup device the alphanumeric characters of the vehicle's license plate together with the hour, minute and second when the vehicle passed by the first sensor and then using a mathematical formula, performs the measurement of the time spent by the vehicle to run the course from the virtual sensor of the first pickup device to the virtual sensor of the second pickup device, and upon comparing the result of the measurement with the input parameters of maximum speed for that section of the way, if the measured speed exceeds that which is permitted for the roadway, there will be definitively stored in the second pickup device the pre-event, the event itself and the post-event in previously defined quantities, already with the data relative to the location, calendar data, maximum speed for the roadway, measured speed and other indispensable data. The measurement of speed using the concept of "average speed along the course" applied in great distances is only made possible in intensive use by the work developed by the automatic alphanumeric data pickup means which upon capturing the data from a license plate sends the same (for instance, via wireless radio) to the other pickup device which will await the passage of that license plate in order to perform the calculations and comparing the result to the maximum permitted speed for that roadway. The data concerning the location, the time and other data required to correctly record the event are recorded in the image and not in two files, thereby the data recorded in the image becoming a part thereof, greatly increasing the level of security and trustworthiness of the data, inhibiting adulterations of the data relative to the event Simultaneously, these images are relayed (for example, via wireless radio) to a monitoring center where they will be analyzed by individuals certified for such purpose. The transfer of data (for example, by wireless means) allows great economy, swiftness and security to the public authorities, since it does not require installation of cabling over common posts or the permanent lease of a twisted conductor pair from the telephone service utility, and also does not require the most common form of operation using vehicles, ladders and personnel performing more than one daily round for each equipment, to collect stored date, as in the case of the conventional pickup devices. The images and data will be transported with a high level of security since there shall be in use a (private or otherwise) data transfer path with cryptographic security. During the course of the vehicle in the vicinity of the monitored area there may be implanted, before and/or between the virtual sensors, at least in a point fixed to the ground, or suspended from supports, a signaling device 208 comprising two colors for the purpose of informing the vehicle whether the same is traveling at a speed that is permitted for that roadway, or whether it is traveling at a speed in excess of that which is permitted for that roadway. In this manner, or example, the driver will be warned by a luminous means located within his or her field of vision that he or she is traveling at a speed in excess of that which is permitted for that roadway, being given time to brake, or that he or she is traveling at a speed which is allowed on that roadway, the information provided by this equipment contributing to strengthen the policy intended to reduce the actual application of fines.

An additional useful aspect is the parallel utilization of the capture of the images for the tasks described in the two preceding uses, and that when sent in real time (by means of wireless radio waves, for example) to a central point make it possible to analyze the traffic conditions in the location of the crossing, which is very valuable for the CTA traffic engineers; the transfer of data by wireless (or other) means provides to the public authorities a significant economy, swiftness and security since it does not require the installation of cables on conventional posts or the permanent lease of a twisted conductor pair from the telephone utility, as it will be using a private pathway to transfer data with cryptographic security.

Another characteristic of the system and method is the use of communication (via wireless radio, for example) for transmission of data with identification of physical objects or vehicles, in movement or stationary, located in the vicinity of the location able to be perceived by the system and method, therefore making it possible to know the location of a certain vehicle within the territorial area where the system and method is in use. This use is very valuable for the public authorities, law enforcement agencies, public transport companies, owners of large fleets that do not always know precisely where their vehicles are. With this equipment, information will be available thereto during most of the day.

BRIEF DESCRIPTION OF THE DRAWINGS

Description of the system.

The system of the present invention will be described with reference to the attached drawings, wherein.

DETAILED DESCRIPTION OF THE INVENTION

Figure 1:
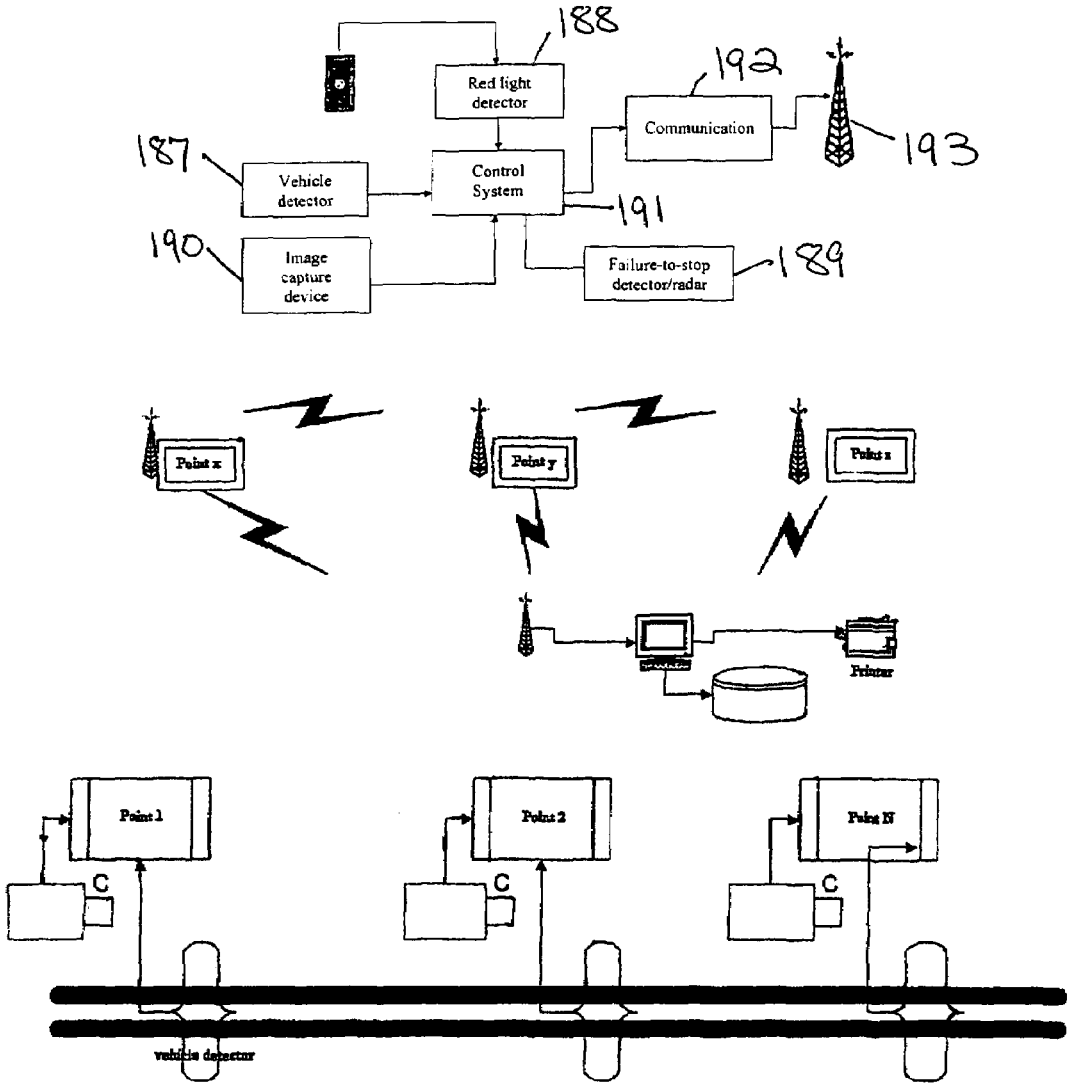
FIG. 1 shows a general diagram of the system according to the invention.
Figure 2:
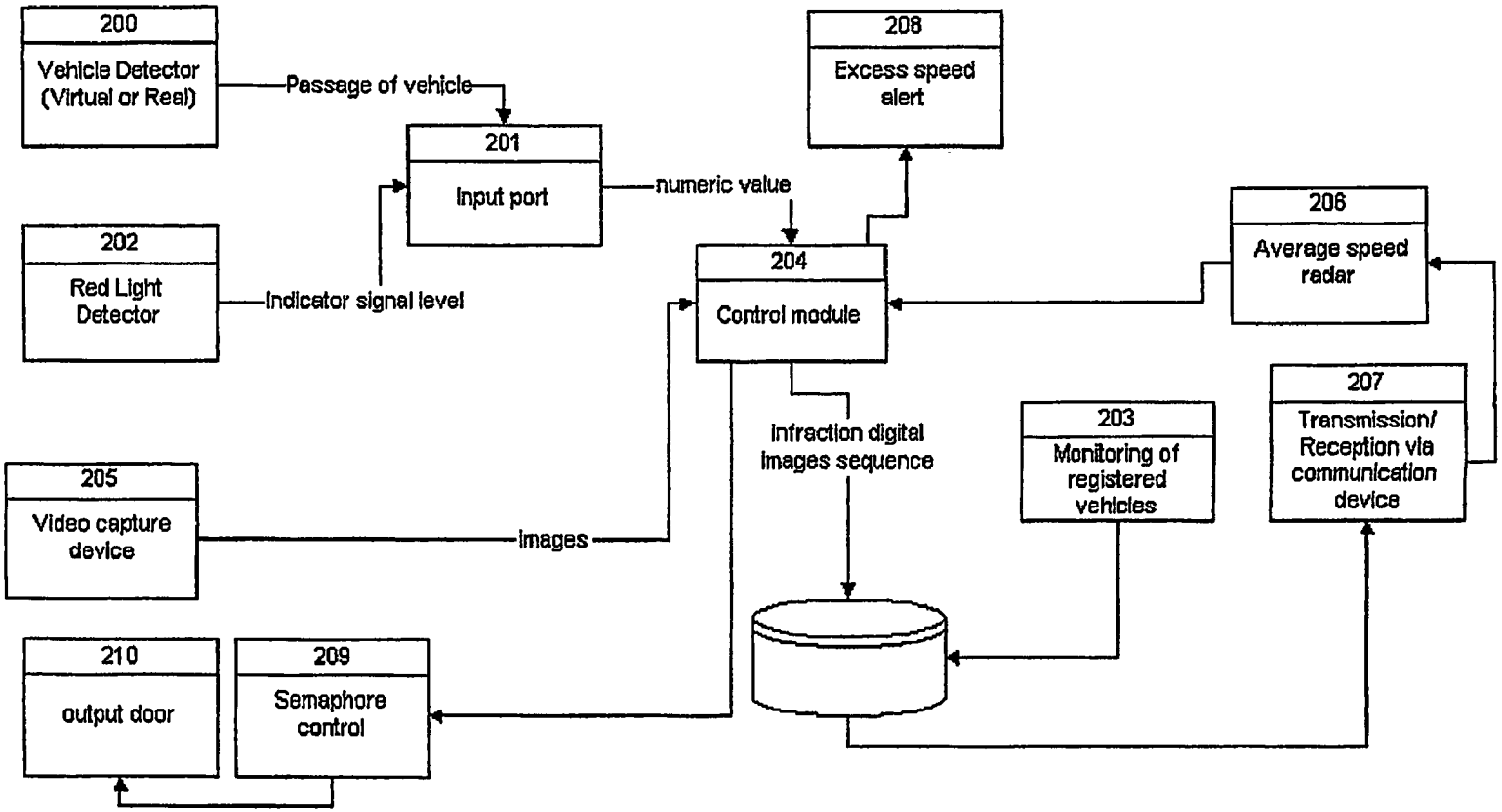
FIG. 2 shows a general functioning scheme of the radar/failure-to-stop control system.

FIG. 1 is a general schematic view of the system according to the invention comprising a vehicle detector 187, a red light detector 188, a radar/failure-to-stop detector 189, an image capture device 190, a control system 191 and a communication line 192 leading to a tower 193.

Figure 3:
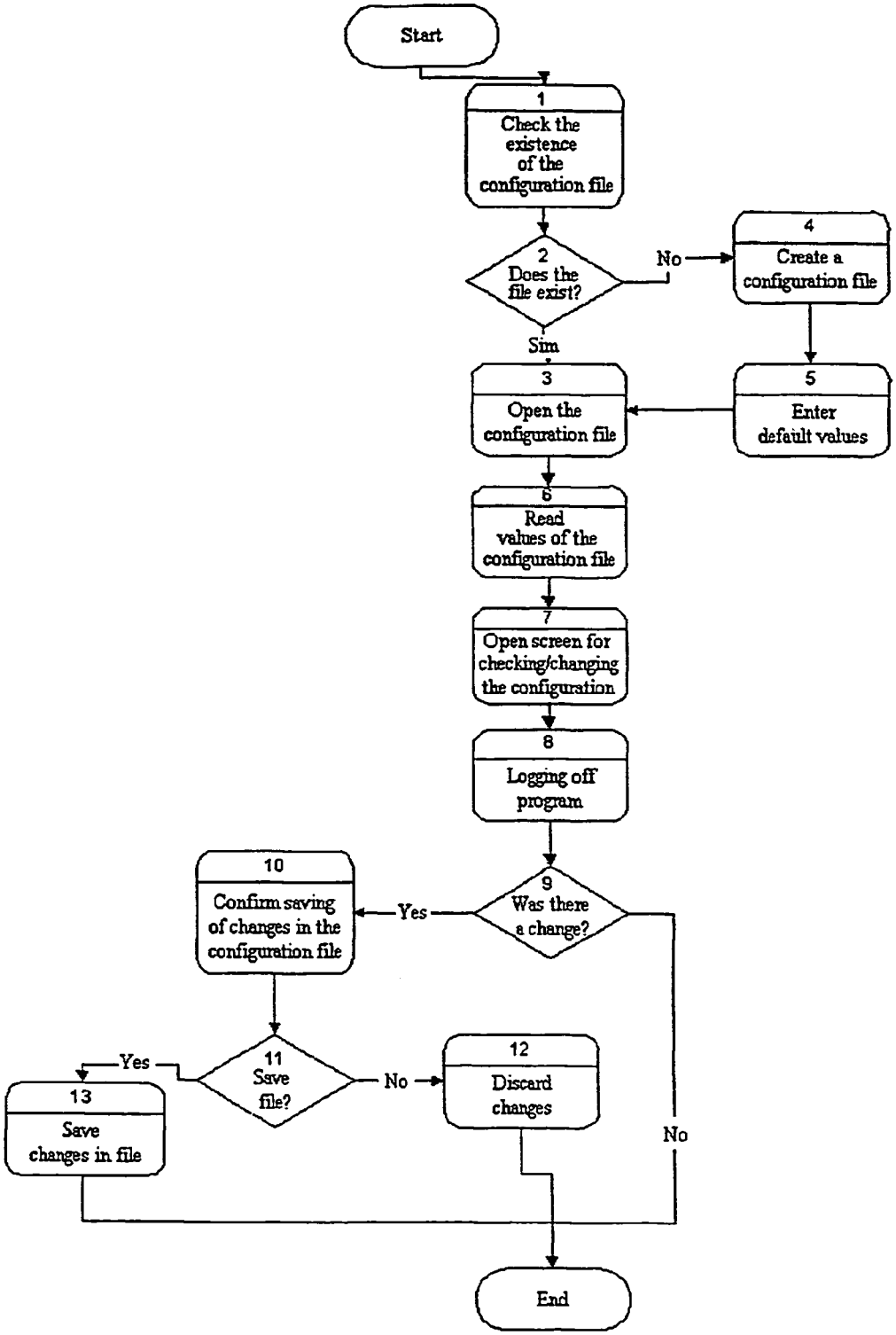
FIG. 3 is a block diagram of the configuration module.

Configuration program: (FIG. 3)

The configuration program starts by checking 1 the existence of the configuration file 2. If the file is nonexistent, a new file will be created 4 and in this file there will be entered default values 5. If the file exists, it is opened 3, the system parameter values are read 6 and displayed on a screen for checking and/or changing the values 7. On closing 8 the configuration program, if there were changes 9, there is displayed a dialog box 10 requesting a confirmation 11 to save the changes. If it is decided to save the changes, the same will be saved 13 in the configuration file, otherwise the changes will be discarded 12.

The structure used for the configuration file follows the definitions of the Windows *.INI file. The *.INI files are text files and are divided into section, key and value. For example:

```
[Section 1]
base=c:\capture
address=Av. Somename, 1234
[Section 2]
counter=3
positionX=230
Example of reading of the file:
bSensor1      :=      aINI.ReadInteger('system','snivel',95);
intDrv1       :=      aINI.ReadInteger('system','drvzoom',1);
intDrv        :=      aINI.ReadInteger('system','drvpan',0);
```

Figure 4:
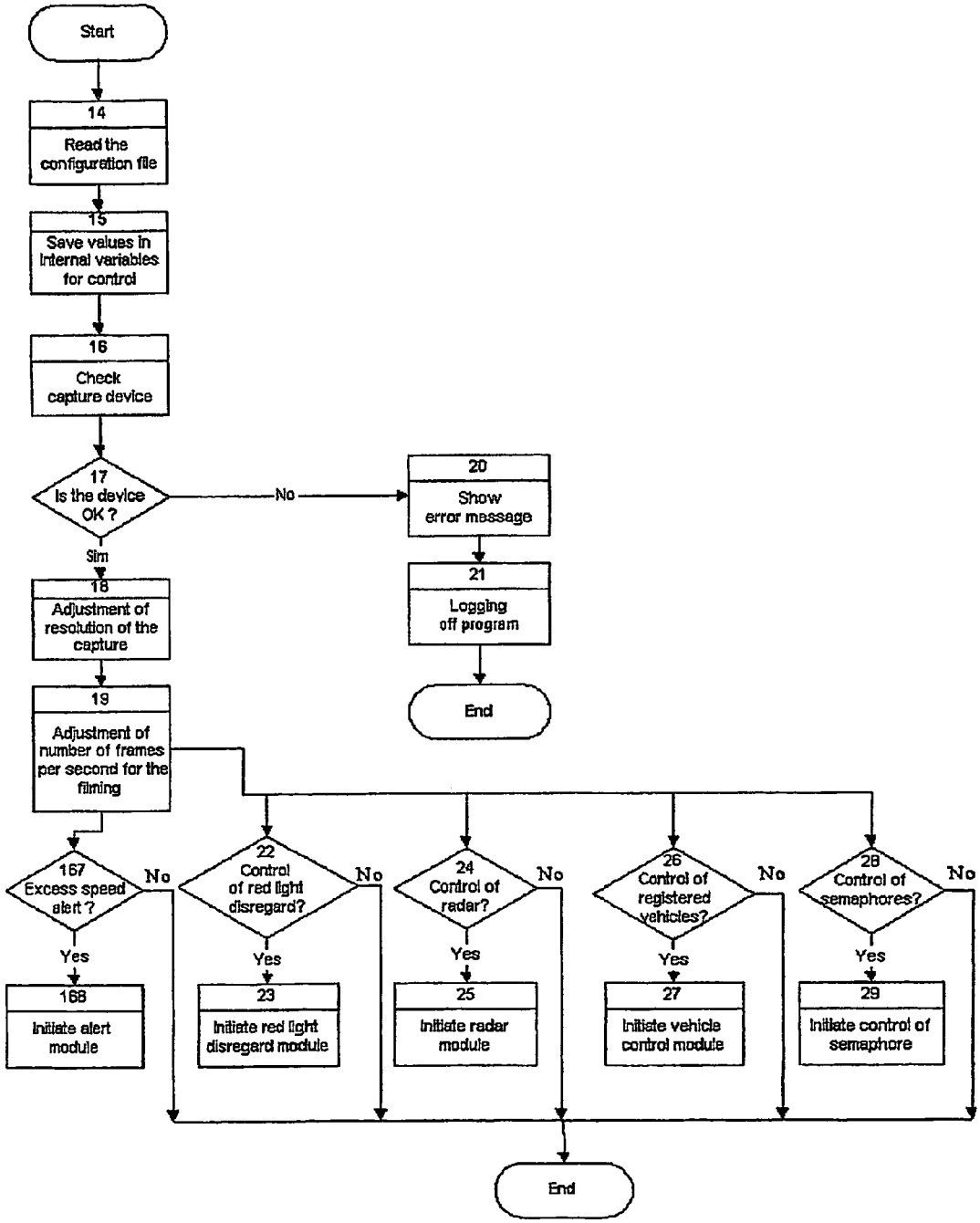
FIG. 4 is a block diagram of the system initialization routine.

System initialization routine (FIG. 4)

Initially the system reads the configuration file 14, the values read from the file are inserted into internal variables of the program 15. These are global variables, since they need to be accessed by all the modules of the system.

After loading the configurations, the initialization process checks the capture devices 16, a test 17 is performed to determine the action to be performed. If any capture device shows any problem, an error message is displayed 20 and the program is closed 21.

If all the devices are in order, the image capture resolution is adjusted 18 in accordance with the specifications found in the configuration file. There is also configured the number of frames per second 19 to be used in the digital images sequence process.

Since the system is run in a multitask and "multithread" operating system the initialization process will run the modules in parallel, according to what is specified in the configuration file. If it is necessary to load the failure-to-stop control module 22, then the initiate module process is run 23, the same being repeated for 24, 25, 26, 27, 28 and 29.

Example:

```
if bolTraffic light then begin
    application.CreateForm(TfrmTraffic light,frmTraffic light);
    frmTraffic light.show;
end;
```

Figure 5:
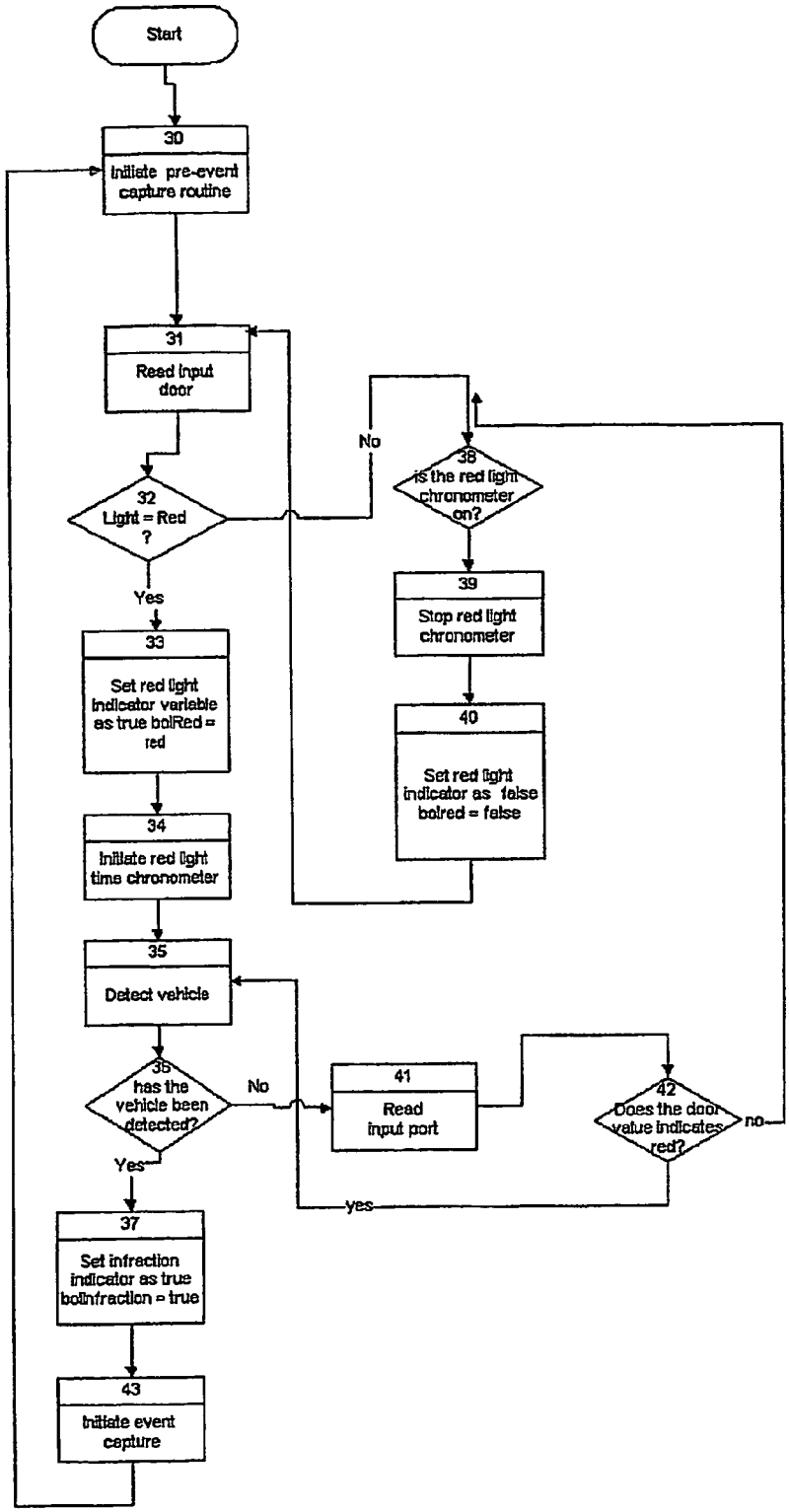
FIG. 5 is a block diagram of the red light failure-to-stop module.
Figure 6:
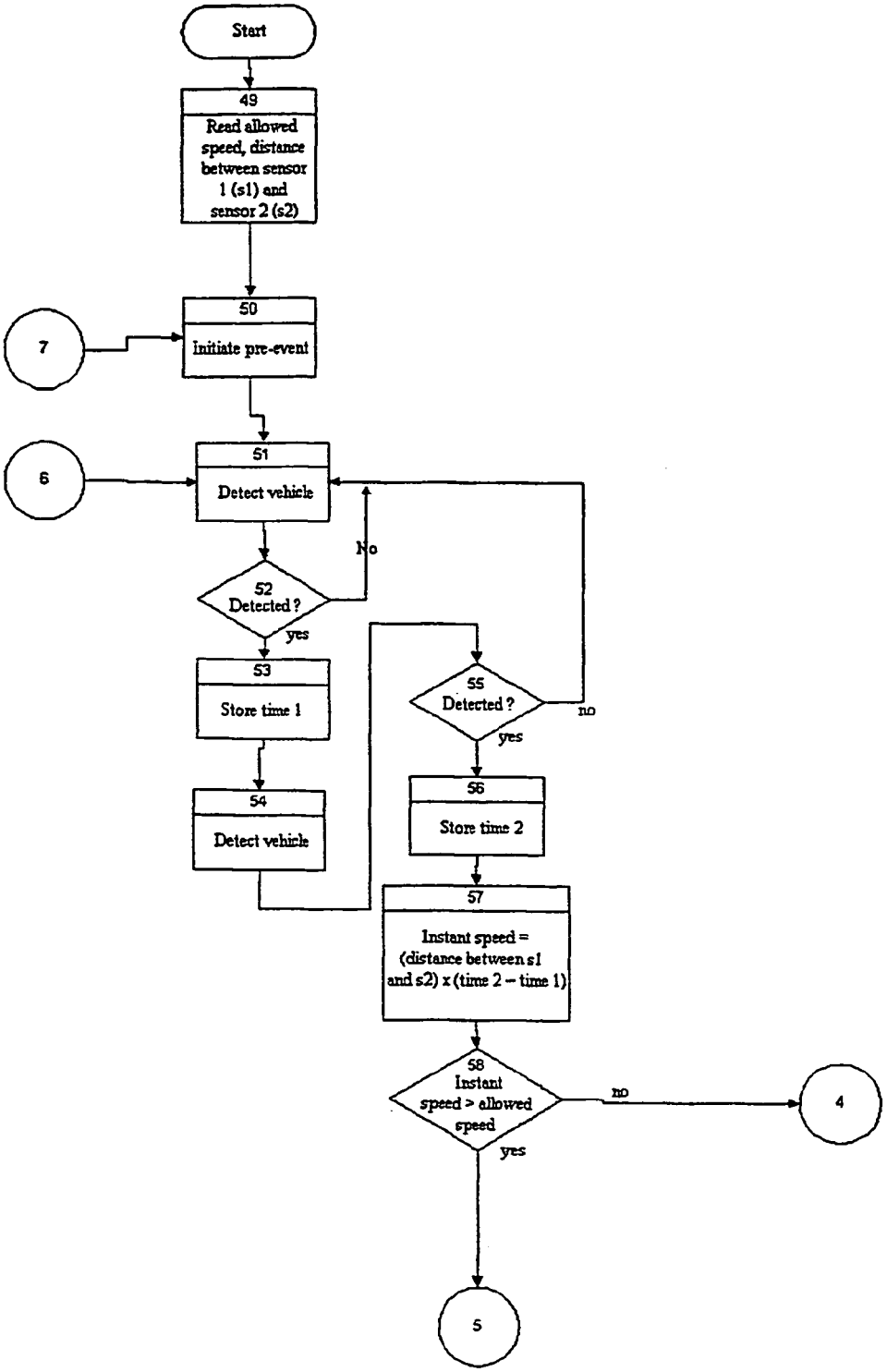
FIG. 6 is a block diagram of the radar module.
Figure 7:
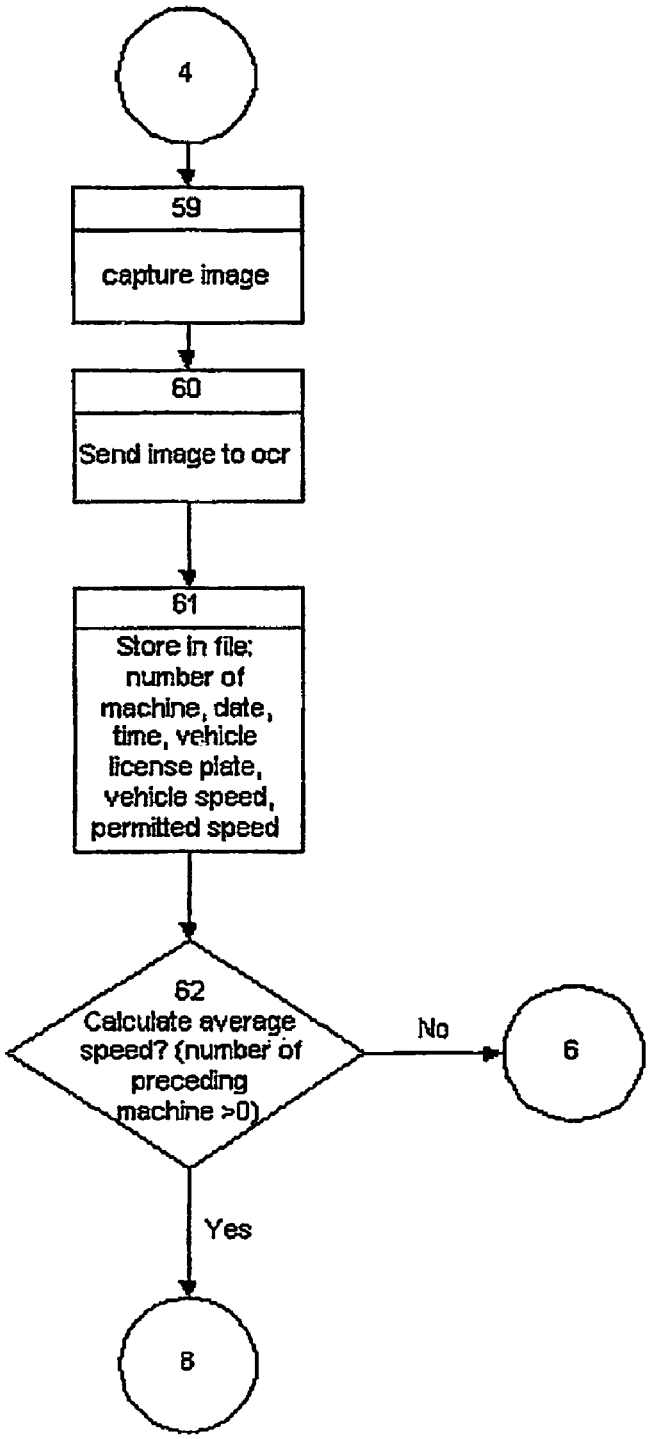
FIG. 7 is a continuation of the block diagram of FIG. 6 relative to the radar module.
Figure 8:
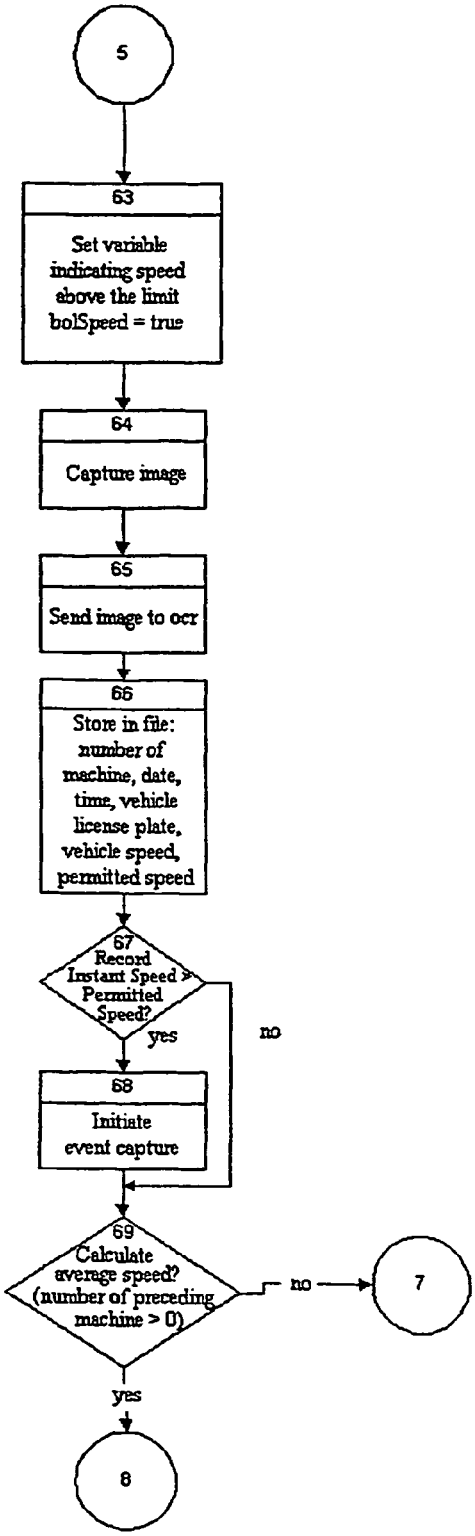
FIG. 8 is a continuation of the block diagram of FIG. 7 relative to the radar module.
Figure 9:
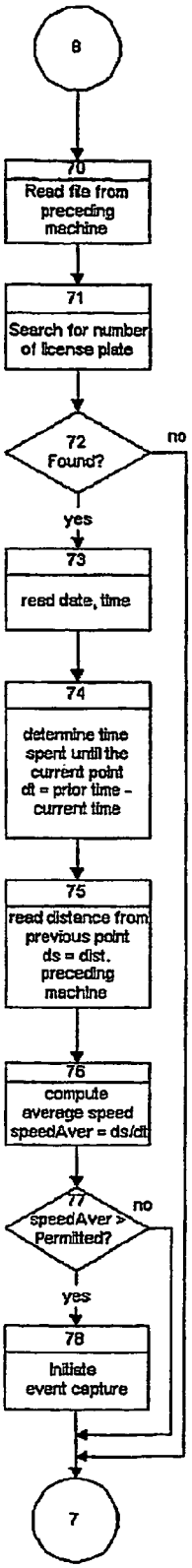
FIG. 9 is a continuation and final part of the block diagram of FIG. 8 relative to the radar module.

Red light failure-to-stop control module (FIG. 5)

The red light failure-to-stop control module monitors whether a vehicle jumped the red light, or stayed immobile over the pedestrian crossing strip while the red light was on. The module functions by detecting, using a sensor, whether the vehicle moved on or stayed on the pedestrian crossing strip.

The pre-event recording routine 30 is the first to be initiated, and is responsible for keeping a digital images sequence of what happens prior to a vehicle committing an infraction (event), should this last actually come to take place.

Thereafter the input port is read 31 and there is checked the return value to identify the red light status 32.

If the stop sign exhibits a red light, the next step consists in inputting the variable (global) that identifies whether the light is red as true 33. This variable, when true, makes the red sign timing chronometer be displayed in the image that is being recorded.

Example:

```
bRed:=true;
    if ((bStatusPort = bRed))
        then begin
            intCount1 := 0;
            intEnd := intTimeBefore;
            timer1.enabled := true;
end;
```

Continuing the process, a red light timing chronometer is initiated 34, and counts the time while the red light stays on. Thereupon there is performed the detection of the vehicle 35. If the vehicle fails to be detected, there is once again performed a reading of the input port 41 and the vehicle detection is repeated 36 until the light ceases to show red 42 or until a vehicle has been detected. When a vehicle is detected, an infraction indicator variable has its value altered to true 37 and the capture (sequence of digital images) shall be that of the post-event. For this purpose a variable indicating the event is placed as true 43.

If the light is not red 32, there is performed a check to determine whether the red light chronometer is on 38, and if the same is on, it is turned off 39 and the value of the red light identifier variable is set to false 40 and the reading of the port is resumed awaiting a new red light cycle.

Radar Module (FIGS. 6, 7, 8 and 9):

In the instant speed radar module, a calculation is made in respect of the vehicle speed dividing the distance between the sensors s1 and s2 by the time spent by the vehicle to pass by the two sensors. If the speed exceeds that which is permitted, an image of the vehicle is recorded, the license plate of the vehicle is determined by means of the OCR and this information is kept in a file for subsequent processing. Thereafter there is started the digital images sequence and the information of date, time, maximum speed allowed on the roadway, measured speed and location of the infraction is inserted in the digital images sequence. At the end of the time interval specified in the configuration file, the digital images sequence ends and the cycle begins once again.

If there is used the average speed method, there is one further configuration file wherein is specified the maximum speed allowed at each point and the average speed along the section of the way.

Example of Configuration

| | Number of points: N | | | | | |
|---|---|---|---|---|---|---|
| | Point 1 | Point 2 | Point 3 | Point 4 | Point n-1 | Point n |
| Speed at Point | 60 | 50 | 70 | 70 | 60 | 80 |
| Average Speed | 55 | | 70 | | 60 | |
| Distance | 500 m | | 2000 m | | 2350 m | |
| Criterion for evaluation | [ x ]> Point 1<br>[ x ]> Point 2<br>[ x ]> Average | | [ ]> Point 3<br>[ ]> Point 4<br>[ x ]> Average | | [ ]> Point n-1<br>[ x ]> Point n<br>[ x ]> Average | |

The process starts reading the maximum allowed speed for the roadway, point (instant) speed and average speed, distances between sensors, and places these values in auxiliary variables 49. These values are read from the variables initialized during the system initialization process.

Thereafter the pre-event is initiated 50, i.e., there is started the recording preceding (in a fixed size temporary file) an infraction (event).

Immediately thereafter the module enters the vehicle detection mode 51, the detection is checked 52 and if no vehicle was detected, it is repeated until a vehicle is detected at the first sensor.

If a vehicle was detected, there is recorded in a variable 53 the time (timestamp hh:mm:ss:ms) and there is started the detection of vehicles at sensor 2, 54. Upon the detection test 55 having a positive result, there is stored the time (timestamp hh:mm:ss:ms) in another variable 56 and there is calculated the speed at this point 57 where Vpoint=(distance between the sensors)/(time2−time 1).

The measured speed is compared with the maximum speed allowed for the roadway 58, and if the instant (point) speed is less than or equal to the maximum allowed speed, an image of the vehicle's license plate is captured 59, this image is sent to a character recognition function (OCR) 60, and as a return of this function there is obtained a string-type variable containing the license plate number, that will be stored in file 61 together with information of date, time, speed measured at the point, speed allowed on the roadway and serial number of the machine.

If the serial number of the preceding machine is greater than zero (this parameter was read from the configuration file during the initialization process), there is performed the calculation of average speed 62.

If the speed measured at the point is greater than the maximum speed allowed for the roadway, the excess speed identifier variable is set to true 63 and an image of the vehicle's license plate is captured 59, this image is sent to a character recognition process (OCR) 60, and as a return of this function there is obtained a string-type variable containing the license plate number, that will be stored in file 61 together with information of date, time, speed measured at the point, speed allowed on the roadway and serial number of the machine.

There is then a need to register the instant (point) speed as an infraction factor 67, if necessary the process resorts to the capture of the event 68 whereby there will be captured (digitally) the sequence of digital images of the infraction occurred according to the time specified in the configuration file.

There is tested the need of average speed calculation 69 and if this is not necessary, the process returns to awaiting the passage of vehicles at the first sensor.

The average speed calculation consists in reading the license plate registration file of the machine that precedes this one 70, this may be achieved by means of disc sharing (via smb or netbeui for example) since the system can communicate by means of a network. There is then searched the license plate 71 recognized in this file (the search key is the license plate). There is checked whether the license plate was found in this file 72. If it is not found the process returns to awaiting the passage of vehicles at the first sensor 51. If the license plate was found in the file, the time read from the file is placed in a variable 73 (time1), and the current time is placed in another variable (time2). The time variation is computed by subtracting time 2–time1 and the result is placed in another variable 74, for example, dt. The distance to the preceding machine is placed in a variable, for example, dS75. The distance to the preceding machine is recorded in the configuration file. Thereafter there is calculated the average speed along the course 76 SpeedAver=dS/dt. There is checked whether the average speed along the course exceeds that which is permitted (configured) 77, and in the affirmative there is started the capture (sequence of digital images) of the event 78. Thereafter the process returns to awaiting the passage of vehicles at the first sensor.

Figure 10:
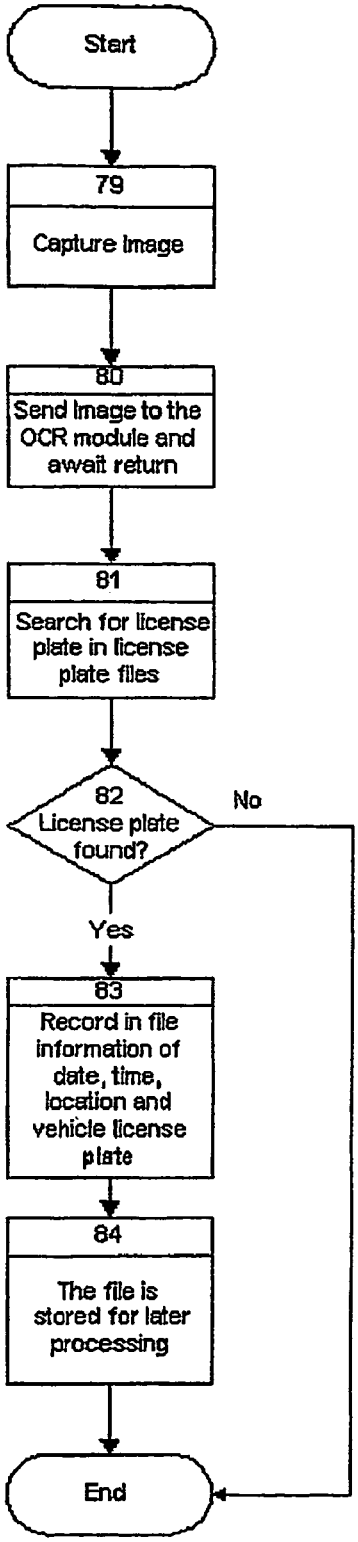
FIG. 10 is a block diagram of the registered vehicles monitoring module.

Registered vehicles monitoring module. (FIG. 10)

An image is captured from the capture device 79 and sent to the character recognition module 80, the returned value being placed in a variable.

Thereafter the license plate is searched in a previously registered license plates file 81. If the license plate is found in this file 82 there is recorded a registration in a file containing the information relative to the vehicle's license plate, date, time and address of the equipment 83. This file may be retrieved 84, (via network or otherwise) for processing of the data thereof in the desired manner, as for instance for statistical purposes.

Figure 11:
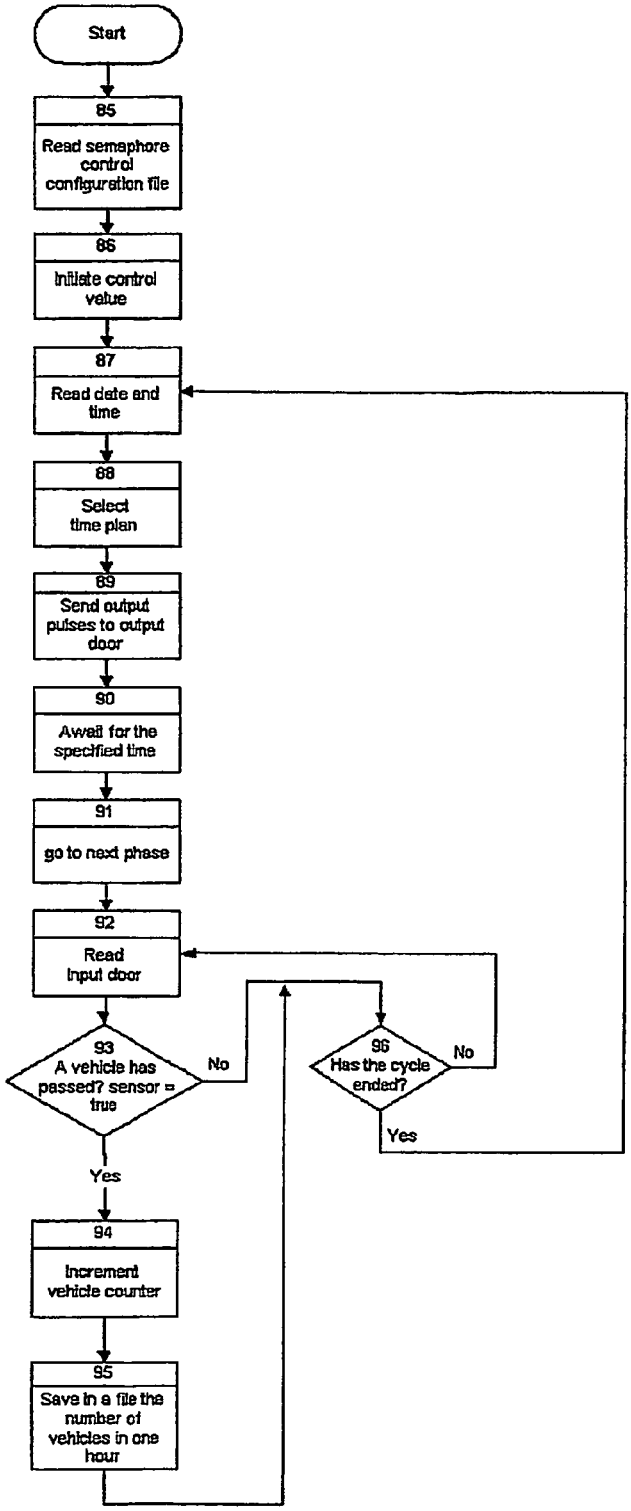
FIG. 11 is a block diagram of the traffic light controller module.

Traffic lights control module (FIG. 11).

Initially the traffic lights control reads a traffic light configuration file 85 wherein is specified whether it is to be a two-stage or a three-stage controller. After this is done, it initializes the control vectors according to the specified traffic light type 86.

Example: If it is a two-stage controller (binary values):

smOut[1]:=100100001001;

smOut[2]:=100100010010;

smOut[3]:=001001100100;

Thereafter there is obtained the date and the time 87 in order to select which time plan 88 will be used. After this, the program starts sending the data to the output port 89, each bit with the value "1" shall turn on one point at the output port, and each bit with the value "0" shall turn off the point at the output port.

It is awaited that the cycle period (specified in the plan) is completed 90, for this purpose there is used a timer or a waiting routine. When the time reaches the end the process goes on to the next phase of the cycle 91, ex: countphase: =countphase+1.

Thereafter the input port is read 92, to detect the passage of vehicles 93, if a vehicle passes 93 the vehicle is counted 94 and the information is saved in a file 95.

A test is made to determine whether the cycle has ended 96, and if the same ended the process is repeated from the reading of date and time 87.

Figure 12:
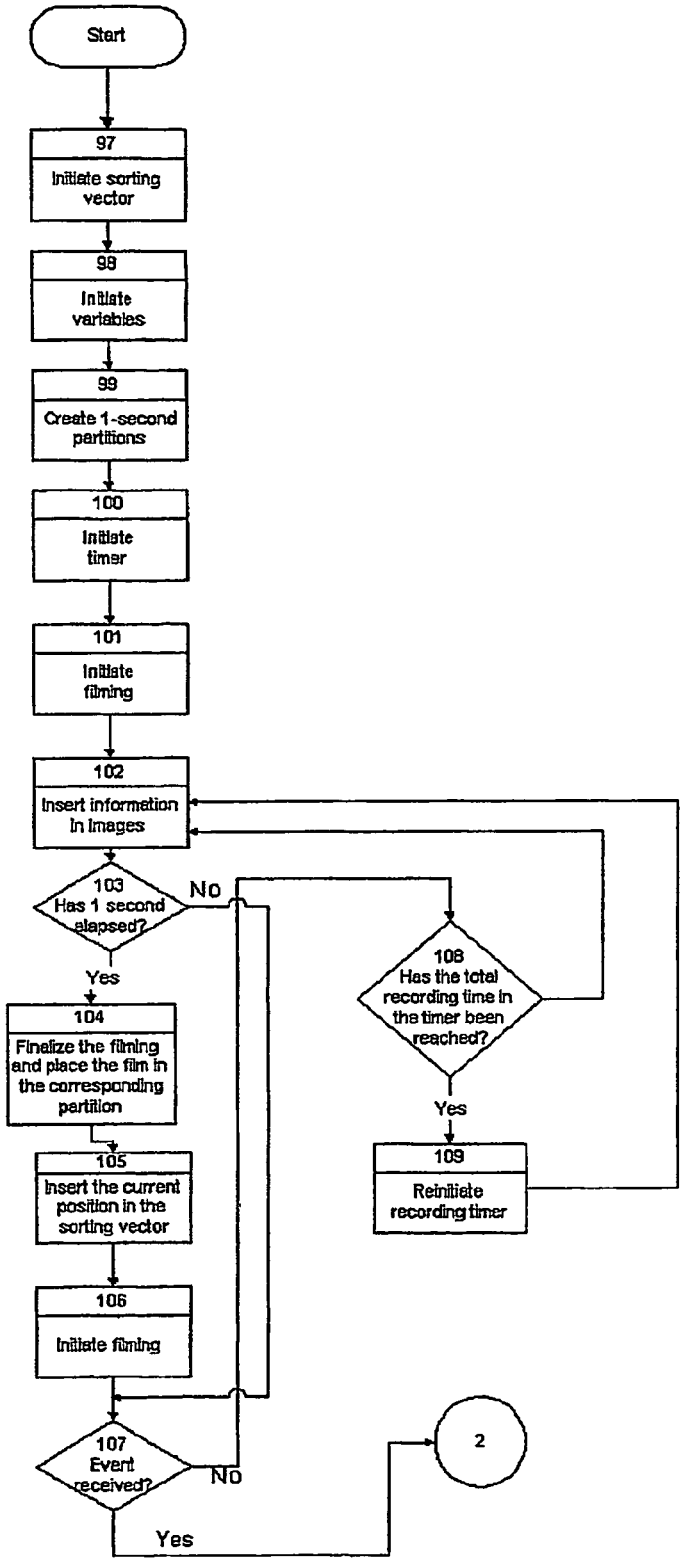
FIG. 12 is a block diagram of the recording of the pre-event and of the post-event.
Figure 13:
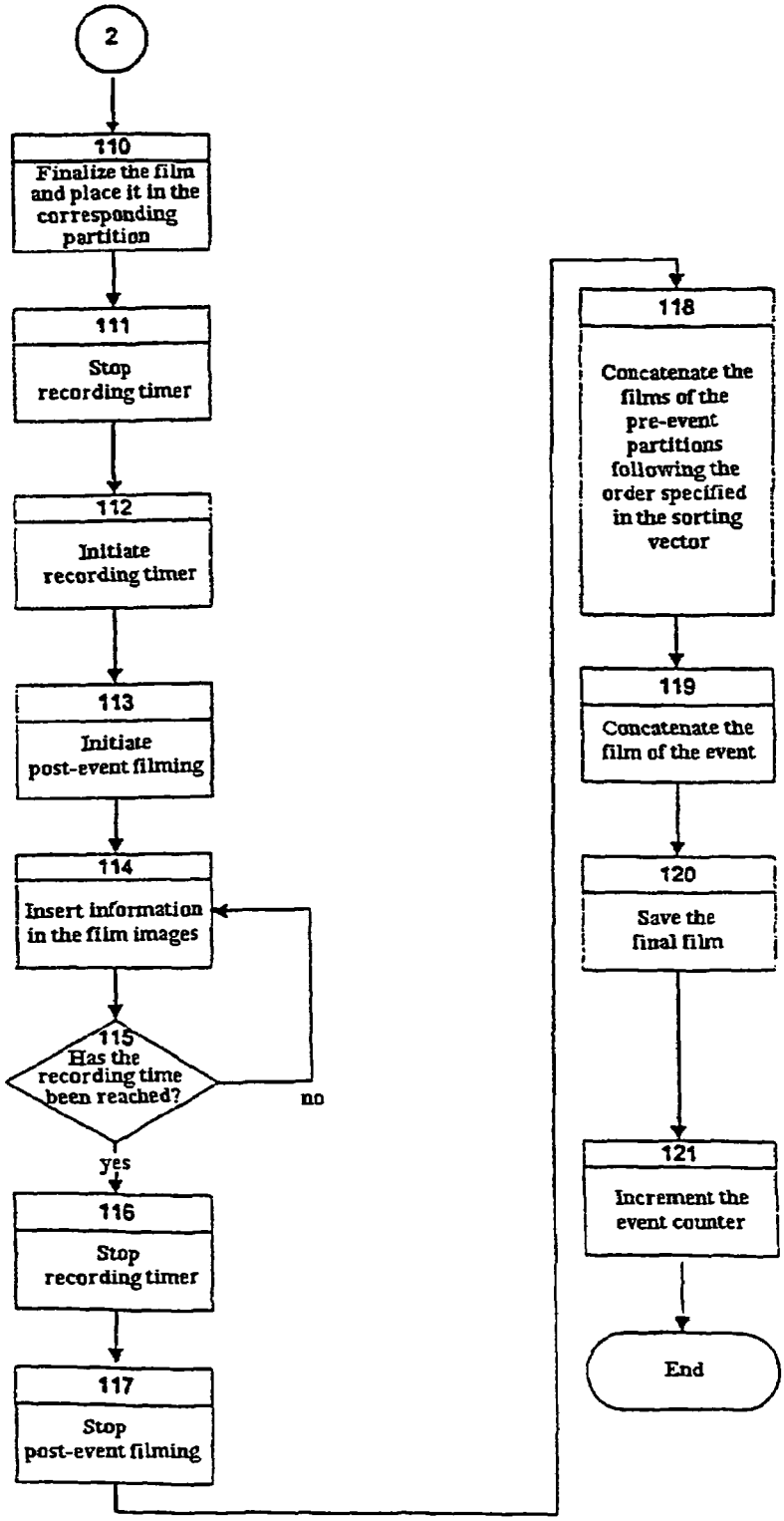
FIG. 13 is a continuation of the block diagram of FIG. 12 relative to the recording of the pre-event and of the post-event.

Digital images sequence module (capture of pre-event and of post-event) (FIGS. 12 and 13)

The recording of the pre-event works with the fact of there being required a continuous recording time wherein the oldest images are gradually discarded. For that purpose there is used a sorting vector, which indicates in which order the partitions of the sequence of digital images (files, for example) will be read.

Example (intTimeBefore is a global variable that contains the value of the pre-event recording time):

```
Const
    MaxTime =60;
    vtSort.array[0 . . . MaxTime] of byte;
procedure Initvt;
var
    i:byte;
begin
    for i:=0 to intTimeBefore vtSort[i]:=0;
end;
```

The digital images sequence of the pre-event is segmented into files with 1 second of duration of the digital images sequence (there may be used a table in a database), and the names thereof are formed by the name of each second, for example. A pre-event time of 5 seconds will create 5 files, which may be named:

1.tmp 2.tmp 3.tmp 4.tmp 5.tmp

When the digital images sequence is running during the first second thereof, there is inserted the value 1 in the sorting vector.

Example of the function insert(pos)

```
procedure Insert( pos : byte);
var
    j : byte;
```

-continued

```
begin
    j:=intTimeBefore;
    while j > 1 do begin
        vtSort[j]:=vtSort[j-1];
        dec(j);
    end;
    vtSort[1]:=pos;
end;
```

And so on. At the time of reading the temporary files to concatenate the same into the final file, there is followed the inverse order of the sorting vector.

Example of reading process:

```
procedure Read;
var
    j:byte;
    strNameFilm : string;
    begin
        j:=intTimeBefore;
        while j>1 do begin
            if vtSort[j] >0 then begin
                strNameFilm:=IntToStr(vtSort[j])+'.tmp';
                Concatenate(strNameFilm);
                    end;
            end;
end;
```

There will be obtained thereby a continuous pre-event recording time since the order of reading of the digital images sequence will always be sequential. For example:

| VALUE INSERTED | SORTING VECTOR |
|---|---|
| 1 | 1 0 0 0 0 |
| 2 | 2 1 0 0 0 |
| 3 | 3 2 1 0 0 |
| 4 | 4 3 2 1 0 |
| 5 | 5 4 3 2 1 |
| 1 | 1 5 4 3 2 |

At first a vector with a number of elements being one unit greater than the time of the digital images sequence in seconds is initiated 97, and all the other variables of the module are thereafter initiated 98. Upon this being done, there are created n partitions 99 with 1 second each, where n is the time specified for recording of the pre-event. After that there is initiated a timer 100 that will keep counting until reaching the specified time. The digital images sequence is started 101, the digital images sequence being performed using video API resources from the operating system being used. During the digital images sequence the necessary information is inserted in the image 102, there is checked if one second has elapsed 103 by querying the timer, if one second did elapse the sequence of digital images is inserted 104 into its corresponding partition (for example, 1.tmp) and there is inserted in the sorting vector the corresponding second 105, and thereafter a new digital images sequence is started 106.

There is tested the event receipt condition 107 wherein a logic variable (global) is tested, and if no event was received, a check is made as to whether the time limit for recording was reached 108 by querying the timer, and if the time limit was not reached, the information continues to be inserted in the image 102, otherwise the recording timer is restarted 109.

If an event was received, the pre-event sequence of digital images is ended 110, it is inserted in its corresponding partition and its order number is inserted in the sorting vector. The timer is stopped immediately afterwards 111.

The timer is started, (now with the post-event recording time 112), the digital images sequence of the post-event is started 113 and until completing the recording time 115 the information continues to be inserted in the image 113.

When the recording time has elapsed, the recording timer is stopped 116 and the post-event digital images sequence is ended 117. The pre-event partitions are concatenated following the order specified in the sorting vector 118 and the post-event sequence of digital images is concatenated, the resulting file being saved as the final sequence of digital images 120. Upon this being done, the event counter is incremented 121, since the name of the final file may have the event number at the beginning thereof.

Figure 14:
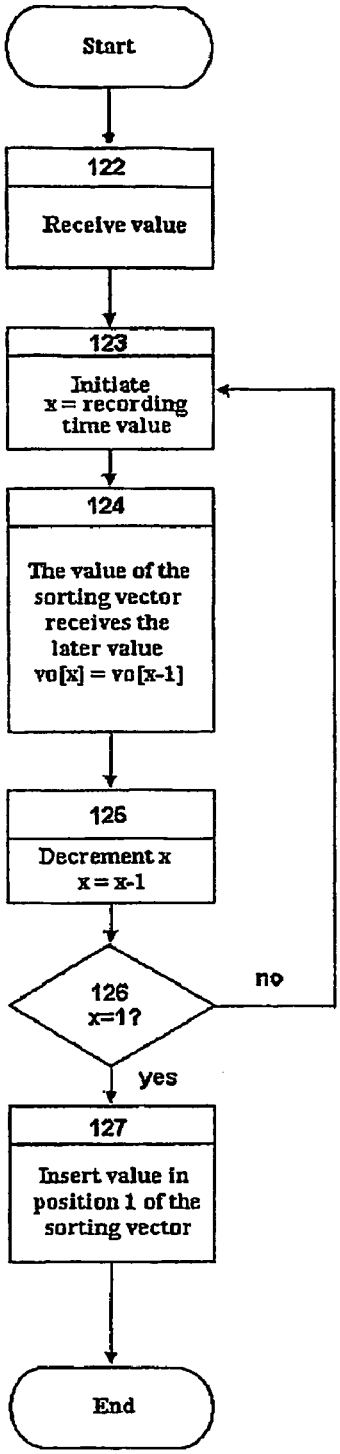
FIG. 14 is a block diagram of the sorting routine for readout of the partitions of the pre-event process.

The sorting routine for sequential reading of the pre-event partitions shown in FIG. 14 consists basically in the alteration of positions within the sorting vector.

Initially it receives the value to be inserted 122, initiates a counting variable with the recording time value 123, while the value of this variable is greater than the value 126 there are repeated the steps of shifting the value from a position 124 and decrementing the counting variable 125. When this variable reaches the value "1", the repetition is discontinued and the received value is inserted in position one of the sorting vector 127.

Figure 15:
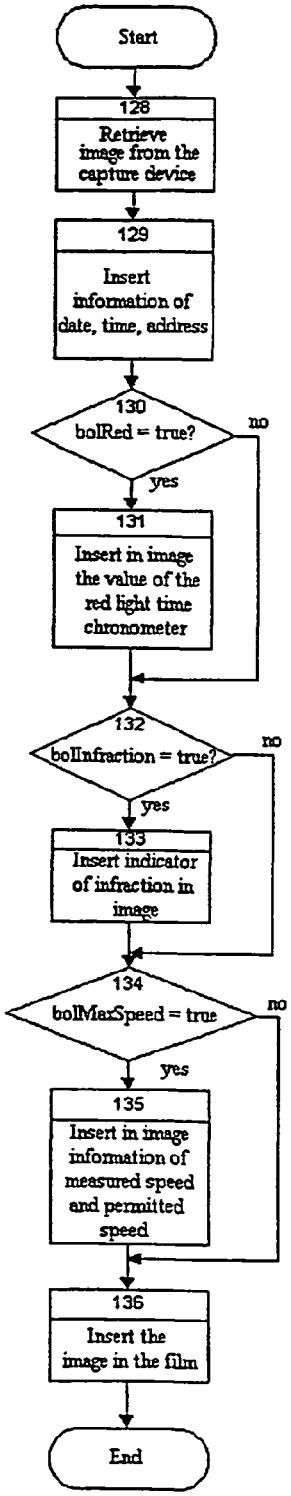
FIG. 15 is a block diagram of the process of recording of information in the digital images sequence.

Process for recording of information in the sequence of digital images (FIG. 15).

The process starts by retrieving an image from the capture device 128, inserting the information relative to date, time and address in the image 129. If the red sign identifier variable is true 130, there is inserted the red light time chronometer information 131.

If there occurred an infraction 132, an infraction indicator is inserted in the image 133; if the speed limit was exceeded 134, the information relative to measured speed and maximum allowed speed is inserted in the image 135.

In the end the image is inserted into the sequence of digital images 136.

Example:

```
procedure TfrmCapture.Capture1VideoStream(sender: TObject; lpVhdr:
PVIDEOHDR);
var
    Bitmap:TBitmap;
    info:TBitmapInfo;
    text:string;
begin
```

-continued

```
    info:=Capture1.BitMapInfo;
    Bitmap:=TBitmap.Create;
    bitmap.Pixelformat:=pf32bit;
    frameToBitmap(Bitmap,lpvhdr^.lpData,Info);
with bitmap do
begin
    canvas.font.Color:=clGreen;
    canvas.font.name:='Arial';
    canvas.font.size:=08;
canvas.font.Style:=[fsbold];
SetBkMode(bitmap.canvas.handle,windows.TRANSPARENT);
if bolInfraction then begin
        text:='INFRACTION';
        canvas.Textout(0,  info.bmiHeader.biHeight
canvas.textheight(text)−27, text);
        bolInfraction := false;
end;
text:= FormatDateTime('dd/mm/yyyy − hh:mm:ss',now) + text3;
canvas.Textout(0, info.bmiHeader.biHeight − canvas.textheight(text), text);
canvas.Textout(200, info.bmiHeader.biHeight − canvas.textheight(text1),
text1);
canvas.Textout(0, info.bmiHeader.biHeight − canvas.textheight(text2) − 17,
text2);
end;
BitmapToFrame(bitmap,lpvhdr^.lpdata,Info);
Bitmap.free;
VideoDisp.DrawStream(lpVhdr^.lpData,  lpVHdr .dwFlags   and
VHDR_KEYFRAME = VHDR_KEYFRAME);
end;
```

Figure 16:
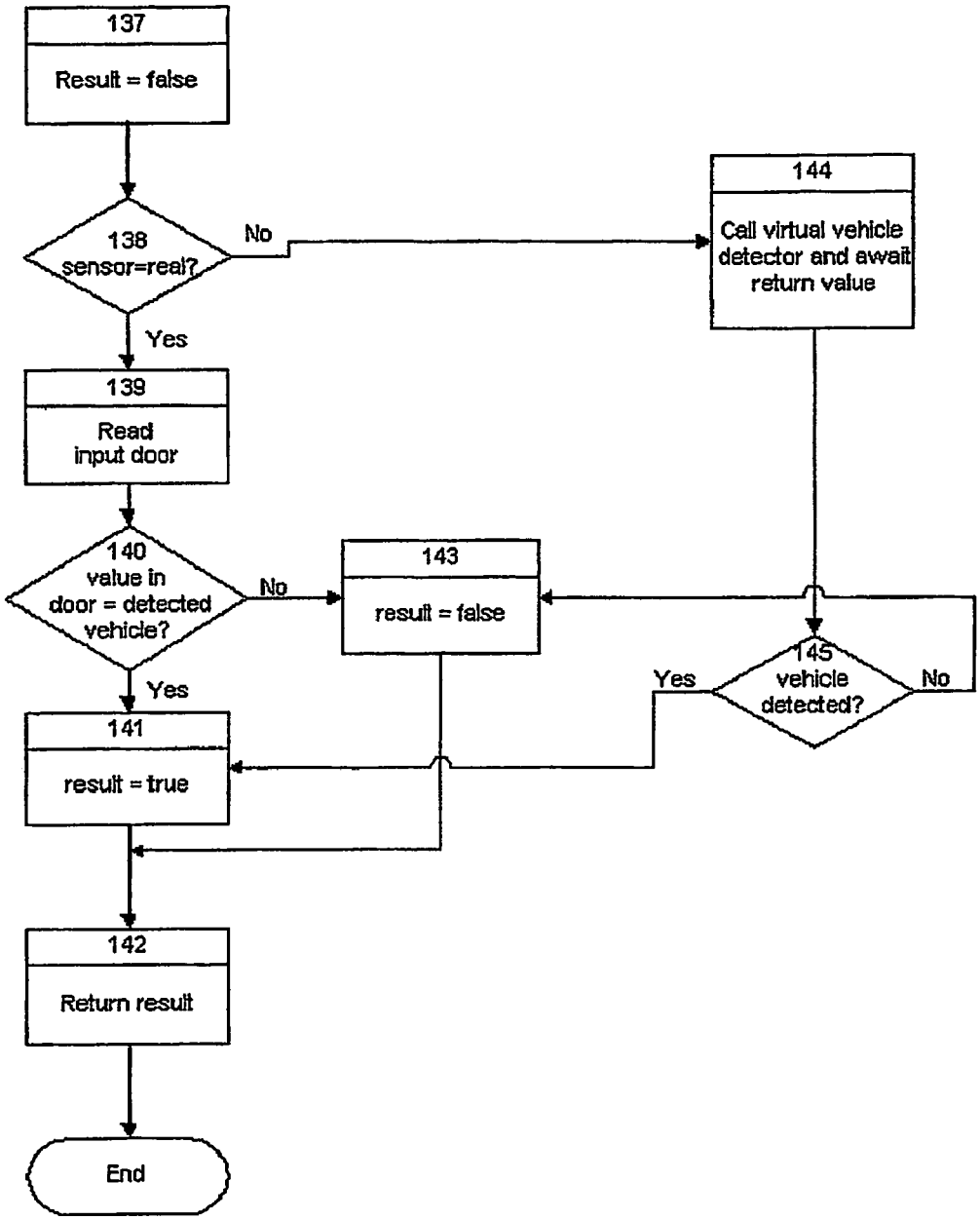
FIG. 16 is a block diagram of the vehicle detector.

Vehicle detector module (FIG. 16):

Initially a variable that indicates whether a detection occurred or not is initialized as false 137, there is checked whether the sensor used is or is not real 138.

If the sensor was used, there is performed a reading of the input port 139, and the value is compared to determine whether or not a vehicle has passed 140. If a vehicle was detected, the value of the identifier variable is set to true 141, otherwise its value will be false 143 and at the end this variable is returned as a result 142.

Example of port reading:

```
function GetPort(aPort:word):word;
var
    bValue : byte;
begin
    asm
        mov dx,aPort
        in al,dx
            mov bValue,al
        end;
    result := bValue;
end;
```

If the sensor used is the virtual sensor, the virtual detection routine is invoked 144, the return value is tested 145, if there occurred a detection of a vehicle, the value of the identifier variable is set to true 141, otherwise its value will be set to false 143 and at the end this variable is returned as the result 142.

Figure 17:
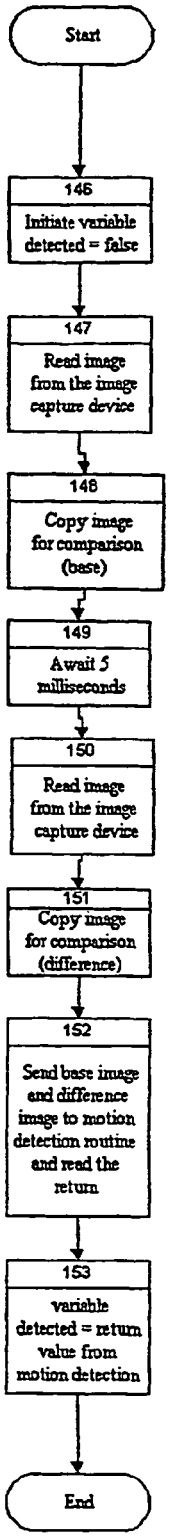
FIG. 17 is a block diagram of the automobile passage detection module—virtual detection.

Virtual detector module (FIG. 17):

There is initialized a detection variable with the value set to false 146, thereafter an image is retrieved from the frame buffer of the capture device 147, this image is copied to a base image 148, there is a delay of 5 milliseconds 149, thereafter a new image is captured 150 which will be the image to be compared, this image is copied 151 to be used to establish differences with the base image, the base image and the difference image are sent to the motion detection routine 152, there should be noted that at this point there may be used even parts of the image, wherein there may be defined detection regions.

The detection identifier variable receives the return value from the motion detection routine 153. This routine ends at this point.

Figure 18:
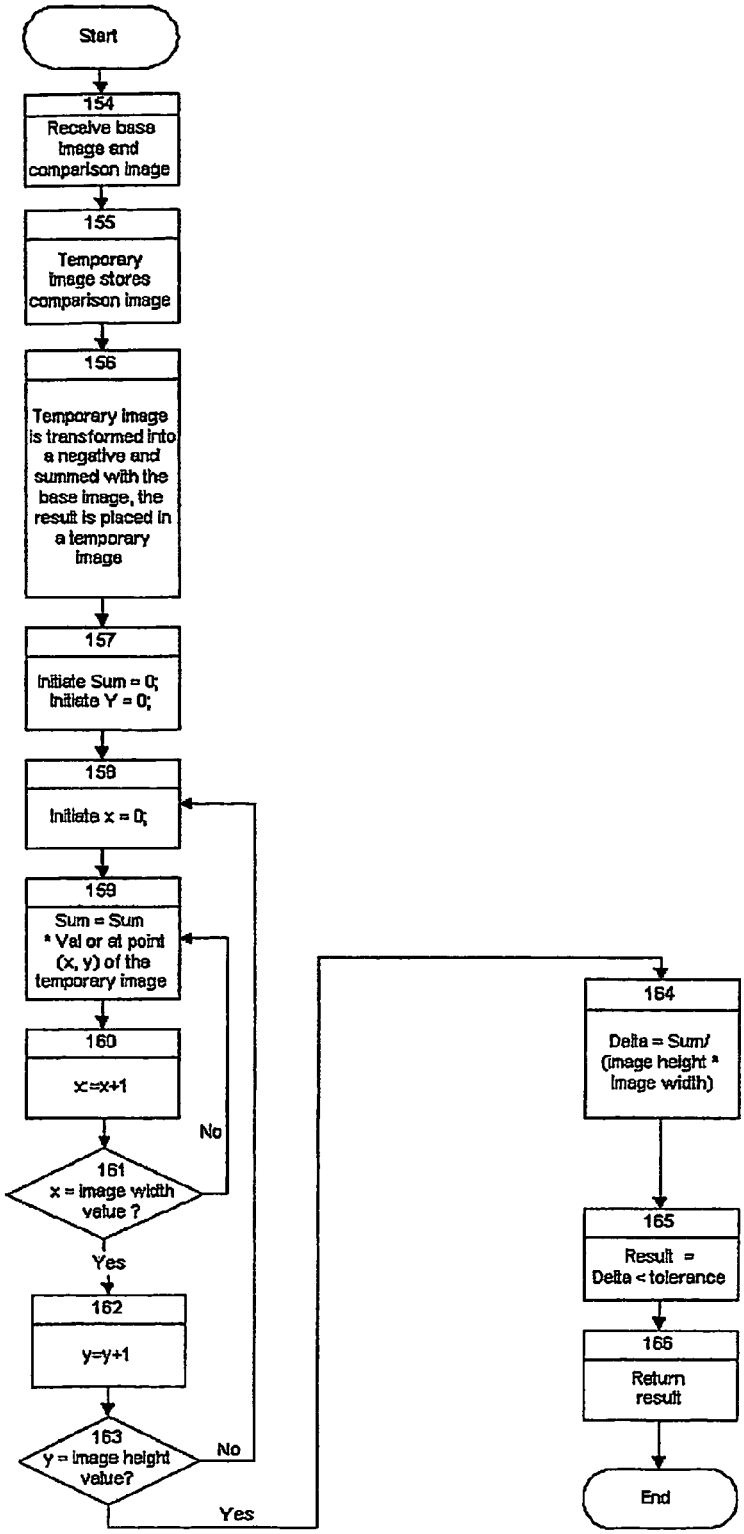
FIG. 18 is a block diagram of the motion detection module.

Motion detection module (FIG. 18):

The motion detection routine consists basically in comparing two images, transforming the precedent image (base) into a negative, adding the current image bit by bit (comparing), then summing the bits of the resulting image. It is obvious that where the dot is black (coincident image), the value of the dot will be zero, where there is a difference of image, the dot will have a value different from zero. If the sum reaches a value above a threshold, that shall serve to characterize that there occurred movement in the space between one image capture and another.

There are received the base image and the comparison image (difference) 154. The comparison image is saved in a temporary image 155, the temporary image is transformed into a negative thereof, the base image is summed with this temporary image and the resulting image is placed into the temporary image 156.

A counter is initiated (ex. y) when scanning the image from the bottom upwards along the vertical coordinates 157 and the value of the sum of values of points of the image is initialized with the value zero. There is initiated the counter of horizontal positions of the image with the value zero 158, while not having reached the end of the horizontal line in the vertical coordinate the value of the dot (x, y) is summed 159, until the horizontal counter reaches its maximum value 161 by successive increments 160. The process then goes to the next vertical coordinate 162 and is repeated until the vertical positions counter reaches its maximum value, that is, the height of the image 163.

Upon ending this process, there is performed a division of the sum of the dots (x, y) by the height of the image multiplied by the width thereof, and the result is stored in a variable 164. As a consequence, this module returns a logic value based on a comparison 165, where the delta value previously computed is less than a threshold specified in the system initialization file. This value is then returned 166 to the module that performed the activation of this module.

Examples:

```
Procedure TMovDetector.Difference(Current, Previous:TImage);
begin
    ImageDif.Picture:=Current.Picture;
    BitBlt(ImageDif.Picture.Bitmap.Canvas.Handle,0,0,ImageDif.Picture.Width,
        ImageDif.Picture.Height,Previous.Picture.Bitmap.Canvas.Handle,    0,0,
        SRCINVERT);
    //Calculation of percentage of black dots
    Edit1.Text:=FloatToStr(1-CalculateBlacks(ImageDif.Picture.BitMap));
    ImageDif.Repaint;
end;
function TMovDetector.CalculateBlacks(BitMap:TBitMap):real;
var
    x,y : integer; P : PByteArray; total,sum:integer;
begin
    Sum:=0;
    for y := 0 to BitMap.height -1 do
    begin
        P := BitMap.ScanLine[y];
        x:=0;
        while x<(BitMap.width*2)-2 do
        begin
            Sum:=Sum+Evaluate(p^[x],p^[x+1]);
            x:=x+2;
        end;
    end;
    total:=BitMap.Height*BitMap.Width;
    if total< >0 then result:=sum/total else result:=0;
end;
```

Figure 19:
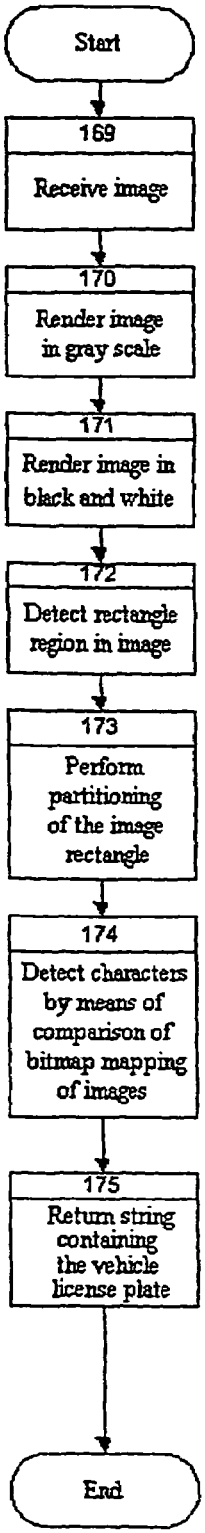
FIG. 19 is a block diagram of the character recognition module.

Character recognition module (FIG. 19):

Initially the image is received 169, being then subjected to several processes aimed at detecting characters. The first process reduces the image to a gray scale image 170, then it is again reduced to two colors, black and white 171. Thereafter a search is made for rectangles 172 in the image, when found the surrounding region is discarded, the remaining image is partitioned 173 to research by comparison of dots in common 174 the characters to be recognized. This is done by means of a comparison between matrixes, the one finding the greatest correlation with the dot matrix of the partitioned region will correspond to the character of the compared matrix.

At the end of the process there is returned a variable containing the characters that identify the license plate of the vehicle 174.

Figure 20:
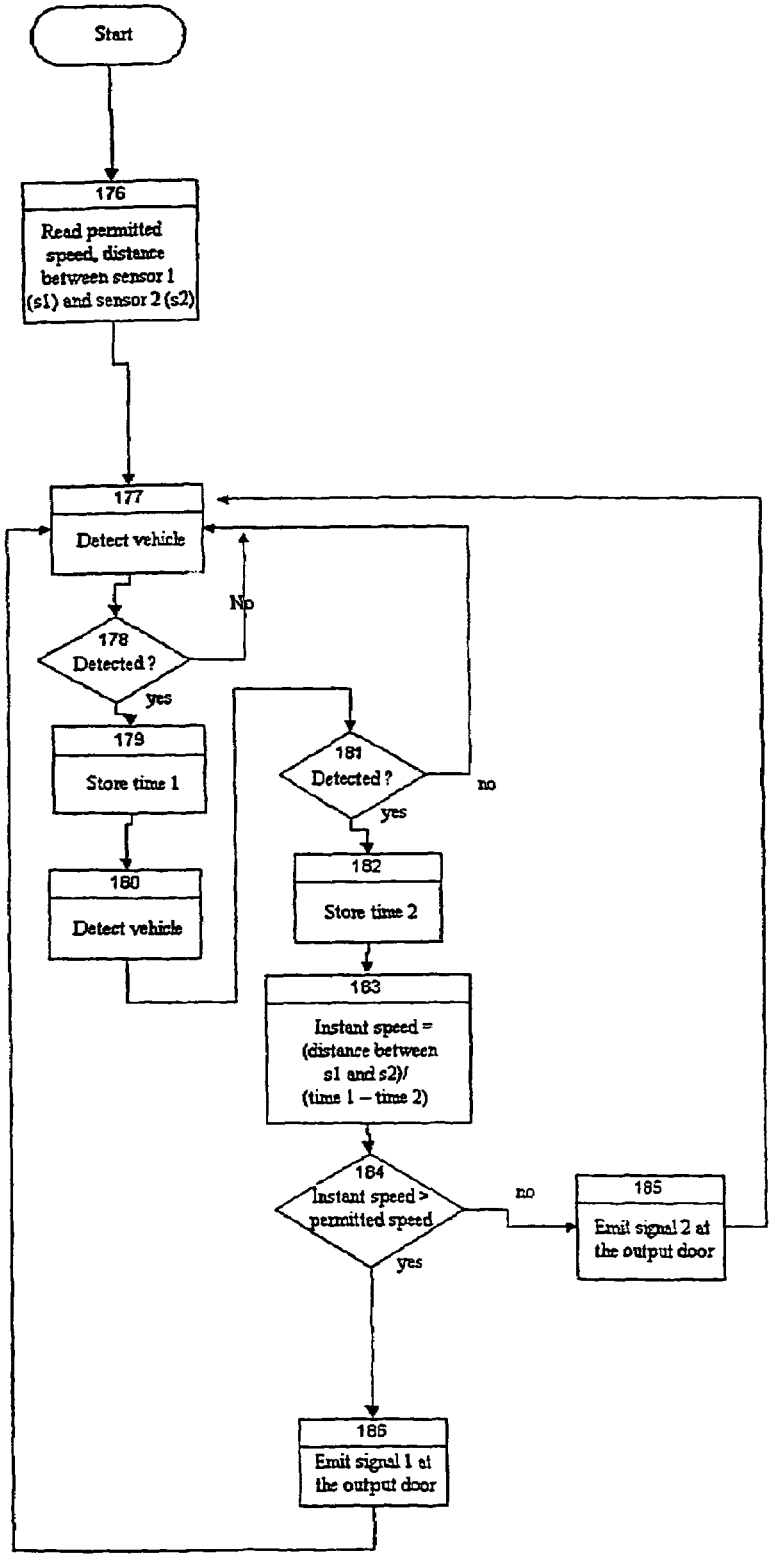
FIG. 20 is a block diagram of the excess speed alert means.

Maximum speed alert module (FIG. 20):

The process starts by reading the maximum speed allowed on the roadway, the instant speed and the average speed, the distance between the sensors, and places the values in auxiliary variables 176. These values are read from the variables initialized during the system initialization process.

Immediately thereafter the module enters the vehicle detection mode 177, the detection is checked 178 and if no vehicle was detected, the process is repeated until a vehicle is detected at the first sensor.

If a vehicle is detected, there is recorded in a variable 179 the time (timestamp hh:mm:ss:ms) and the detection of vehicles is initiated in sensor 2, 180. Upon the detection check 181 having a positive result, there is stored the time (timestamp hh:mm:ss:ms) in another variable 182 and there is performed the speed calculation at this point 183 where Vpoint=(distance between the sensors)/(time2−time1).

The measured speed is compared with the maximum speed allowed for the roadway 184, and if the instant speed is greater than the maximum allowed speed, a signal is sent to the output port in order that a set of indicators inform the driver that he or she is traveling above the speed allowed for the roadway 186, otherwise a signal 185 is sent to the output port such that the signaling devices inform the driver that he or she is driving within the allowed speed limit.

What is claimed is:

1. An event detection-storage system comprising:

a vehicle detection device connected to an input port to detect passage of a vehicle;

a traffic sign red light detector, a registered vehicles monitoring array, a control module that manipulates an infraction film sequence in association with the registered vehicles monitoring array, a video capture device that supplies images to the control module, a radar, a data transmission and reception device connected to the radar, an excess speed alert device, and a semaphore control connected to an output port, whereby the system is continuously recording images and whereby during the operation of the system, the infraction film sequence is generated such that when an event occurs, the infraction film sequence includes images for a time prior to the event, during the event and after the event.

2. A system according to claim 1, wherein the vehicle detection device is a motion sensor that works by regions.

3. A system according to claim 1, wherein the radar is a radar system capable of calculating speed on-the-spot and average speed.

4. The system according to claim 1, wherein the system is continuously recording images in a memory loop.

5. An event detection-storage method, comprising:

monitoring a presence of a vehicle at any point through an automatic alphanumeric recognition of data from a license plate of the vehicle, via a first pickup device interconnected with a second pickup device, wherein each pickup device has a virtual sensor, and wherein each pickup device recognizes the alphanumeric data of the vehicle's license plate together with the hour, minute and second when the vehicle passed by the sensor of the respective pickup device, measuring the time spent by the vehicle to go from the virtual sensor of the first pickup device until the virtual sensor of the second pickup device, calculating the speed of the vehicle using the concept of average speed along the course based on distance between the virtual sensors of the pickup devices and on the time measured in said measuring step, comparing the calculated speed with the speed limit for the roadway in that section, and if the calculated speed is greater than the speed limit, the second pickup device will store images of the pre-event, event and post-event, such storage being in quantities previously defined with data pertaining to the location, date and time, the speed limit, and the calculated speed, wherein the data relative to the location, the time and other data necessary for correctly recording the event is recorded in the images and not in a separate file, whereby the recorded data becomes a part of the images, and sending said images to a monitoring center where they will be analyzed by skilled persons, wherein the images and the data are transported with a high level of security through a path for data transfer having cryptographic security.

6. A method for generating an infraction film sequence in an event detection-storage system comprising:

a vehicle detection device connected to an input port to detect passage of a vehicle;

a traffic sign red light detector, a registered vehicles monitoring array, a control module that manipulates an infraction film sequence in association with the registered vehicles monitoring array, a video capture device that supplies images to the control module, a radar, a data transmission and reception device connected to the radar, an excess speed alert device, and a semaphore control connected to an output port, whereby during the operation of the system, the infraction film sequence is generated such that when an event occurs, the infraction film sequence includes images for a time prior to the event, during the event and after the event; comprising:

a) initiating a sorting vector, b) initiating variables, c) creating 1-second partitions, d) initiating a recording timer, e) initiating filming of images, f) inserting information in the images, g) if one second has elapsed on the timer, finalizing the film and placing it in the corresponding partition to form a pre-event partition, inserting the current position in the sorting vector, and initiating the filming, h) if an event was not received, and the total recording time in the timer was not reached, returning to step (f), i) if an event was not received, and the total recording time in the timer was reached, reinitiating the recording timer and returning to step (f), j) finalizing the film and placing it in the corresponding partition to form an event film, k) stopping the recording timer, l) initiating the recording timer, m) initiating filming of post-event images, n) inserting information in the post-event images, o) if the total recording time in the recording timer was not reached, returning to step (1), otherwise stopping the recording timer, p) stopping filming of the post-event, q) concatenating the images of the pre-event partitions following the order specified in the sorting vector, r) concatenating the event film, s) saving the final film as an infraction film sequence, and t) incrementing the event counter.

7. The method according to claim 6, wherein the system is continuously recording images.

8. The method according to claim 7, wherein the system is continuously recording images in a memory loop.

* * * * *